US008176959B2

(12) United States Patent
Lam

(10) Patent No.: US 8,176,959 B2
(45) Date of Patent: May 15, 2012

(54) MULTI-FUNCTIONAL TAPE APPLICATOR

(75) Inventor: Joe Augustine S. T. Lam, Vancouver (CA)

(73) Assignee: Lamus Enterprises Inc., Vancouver, British Columbia (CA)

( * ) Notice: Subject to any disclaimer, the term of this patent is extended or adjusted under 35 U.S.C. 154(b) by 409 days.

(21) Appl. No.: 12/318,877

(22) Filed: Jan. 12, 2009

(65) Prior Publication Data

US 2010/0175836 A1 Jul. 15, 2010

(51) Int. Cl.
*B65B 51/06* (2006.01)

(52) U.S. Cl. ..... 156/468; 156/502

(58) Field of Classification Search ..... 156/384, 156/494, 502, 504, 505, 538, 541, 577, 584; 242/129.6, 324.2, 326, 326.1, 335, 338.4, 242/588, 588.6, 597.2, 597.6, 598.2, 598.3, 242/598.4, 599

See application file for complete search history.

(56) References Cited

U.S. PATENT DOCUMENTS

| | | | | |
|---|---|---|---|---|
| 3,915,786 | A * | 10/1975 | Collett et al. | 156/355 |
| 4,640,731 | A | 2/1987 | Lerner et al. | |
| 4,642,157 | A * | 2/1987 | Cavanagh | 156/468 |
| 4,789,418 | A * | 12/1988 | Rayl | 156/468 |
| 5,227,002 | A | 7/1993 | Faust et al. | |
| 5,462,633 | A * | 10/1995 | Manusch et al. | 156/577 |
| 5,735,101 | A * | 4/1998 | Shing-Tak Lam | 53/136.1 |
| 7,836,932 | B2 * | 11/2010 | Lucht | 156/479 |
| 2002/0189746 | A1 | 12/2002 | Kuta et al. | |
| 2004/0211525 | A1 * | 10/2004 | Boutin | 156/577 |
| 2008/0264571 | A1 * | 10/2008 | Lam | 156/530 |

FOREIGN PATENT DOCUMENTS

| | | |
|---|---|---|
| GB | 232543 | 11/1998 |

* cited by examiner

*Primary Examiner* — Khanh P Nguyen
*Assistant Examiner* — Vishal I Patel

(57) ABSTRACT

A multifunction tape applicator for applying a section or sections of pressure sensitive adhesive tape to a carton selectively in different carton sealing configurations, namely C-clip; single L-clip, front and back L-clips and sectional skip-gap taping. The multifunction tape applicator comprises a basic tape applicator unit to apply a common C-clip tape from a tape roll with built-in design apparatus for tape applying, tape cutting, tape tension control to facilitate other functions and a mechanical or powered actuation attachment unit which is to be installed onto the modified basic tape applicator unit to actuate other functions based on the requirement of the application.

16 Claims, 17 Drawing Sheets

MULTI-FUNCTIONAL TAPE APPLICATOR

FIELD OF INVENTION

The present invention relates to a multi-functional tape applicator for selectively applying closure tapes in different configurations such as L-clip and C-clip configurations.

BACKGROUND OF THE PRESENT INVENTION

Equipment for applying tape in a C-clip configuration is very well known and is commonplace in the literature and the industry. C-clip configuration generally applies a continuous ribbon of tape starting on a leading face of a case or carton passing through the machine along the surface of the case facing the taper and at least partway along the trailing face of the case i.e. the ribbon of tape forms a C-shape.

L-clip configuration generally applies a ribbon of tape along two adjacent a faces of case e.g. around a corner of the case i.e. the ribbon of tape is formed into an L-shape.

"L"-clip taping fulfills the "sustainability" packaging requirements in material and cost-saving comparing to the common "C"-clip taping. The concept of L-clip taping is known attention is directed to U.S. Pat. No. 4,640,731 that employs 2 separate applicators one to apply an L clip to the leading end and the other to apply an L clip to the trailing end of the case. U.S. Pat. No. 4,642,157 applies an L-clip using and application roll to apply the tape to one wall of the case and then a separate wipe down roll to apply the tape to an adjacent surface of the case. This device can only apply an L clip to the leading end of the case. Similarly U.S. Pat. No. 5,227,002 provides a device that can apply a tape in an L-clip configuration to leading face only of a case.

Majority of carton closure do not require a continuous C-clip tape to seal the full length of the flaps, particularly carton package for the domestic business to business market where the tape sealed cartons are stacked, palletized and pallet wrapped with plastic film for shipping and storage.

An L-clip configuration of a sealing tape is ideal for light weight cartons; single hinged flap cartons; tray carton with top lid; half slotted case, etc.

The L-clips generally may be peeled off easily by hand without the use of box cutting knife, eliminating injuries and product damages when opening the carton with knife.

In general, the adhesion and the strength of the pressure sensitive tape material are strong enough to withstand the weight of the content inside the carton with only the front and the back L-clips tape on top or at the bottom of the carton.

C-clip taping provides a more secure and dust/inserts/tamper proof package. It is ideal for individual consumer package subject to multi-handling and or over-sea shipping.

Regardless of all the obvious benefits of "L"-clip taping, the "C"-clip tape applicators are much more simple, reliable and user-friendly. Mostly operate mechanically without power-driven. They can be removed from the machine for tape replenishing with no tools. Because of its simplicity; low cost; easy to use and low maintenance as well as its long history of taping method, the popularity of C-clip taping remains very strong in the industry.

The currently available L-clip tape applicators in the industry are dedicated for L-clip taping only, mostly operated by air cylinder with electrical control, meaning external sensors wiring and two power sources are required. Mechanical non-powered L-clip tape applicators with separated front and back units are too complicated since it has two individual tape rolls and other duplicated apparatus (see U.S. Pat. No. 4,640,731 referred to above). They are not particularly user-friendly.

In general, L-clip tape applicators are much larger in size than conventional C-clip applicators and require more mounting space, extra wiring, special installation and a longer drive system to accommodate the tape applicator. Since the known L-clip tape applicators are dedicated for a single function, the carton sealing machine is dedicated for "L"-clip taping only. In situation where it is required to change the taping configuration, it is necessary to replace the entire tape applicator accordingly. The machine has to be shut down for the removal and disconnection of the existing unit and the installation, connection and set up of a different tape applicator.

The concept of a multifunctional taper capable (with minor adjustments) to apply a tape selectively in a C-clip or L-clip configuration not taught in any of the reference Applicant has seen.

BRIEF DESCRIPTION OF THE PRESENT INVENTION

It is an object of the present invention to provide to provide a multifunction tape applicator which is multifunctional in terms of changing from C-clip to single or front and back L-clips or vise versa depending on the carton sealing requirement. It will be apparent that if one were only interested in applying say a pair of L-clips the multifunctionality of the applicator could be compromised and the system be fixed in position to only apply tapes in that manner.

Broadly the present invention relates to a multifunction tape applicator for selectively applying a closing tape ribbon to a carton comprising a source of tape, an application roll assembly including an application roll to apply a leading end of a tape from said source to a leading face and around an edge and an adjacent face of a carton moving relative to said tape applicator, a wipe down assembly including a wipe down roll to wipe a tape applied to said carton along a trailing face of said carton remote from said leading face, a push bar link interconnecting said application roll assembly and said wipe down assembly, an over-travel system for moving said application roll from said adjacent face of said carton to an over-travel position and a cutting assembly including a cut off blade against which said tape is moved when said over-travel system moves said application roll to said over-travel position.

Preferably said over-travel system is selectively actuable.

Preferably the wipe down roll is mounted on and adjacent to a free end of a wipe down arm, via a pivotable connection connecting said wipe down arm to a wipe down link and said wipe down roll is biased toward said carton.

Preferably the push bar link is connected to the wipe down assembly via a lost motion connection preferably in the form of a pin and slot connection.

In some embodiments the wipe down roll is compressible and a compressible stop is positioned to engage said wipe down assembly and said compressible wipe down roll and said compressible are compressed by movement of said application roll into said over-travel position.

Preferably the over-travel system is selectively actuated by an actuator comprised of an actuator cam that combines with a slide plate to which a cam element is mounted to move said slide plate and thereby said cam element to its over-travel position and a cam follower on said push link engages said cam plate to move said application roll to said over-travel position.

Preferably, said a cam follower is selectively moveable between an operative position wherein said cam follower is engages and is moved by said cam plate and an inoperative position wherein said cam follower cannot interact with said cam plate.

Preferably, said actuator cam comprise a U-shaped element having a leading face engaging leg and a trailing leg interconnected by a bridging section, said actuator cam positioned so that said leading face engaging leg engages said leading face and then said adjacent face of said carton as said carton is moved relative to said tape applicator to move said slide plate to its over-travel position.

In another system said over-travel system further comprises a sensors to sense a position of said carton as it is moved relative to said applicator and an actuator actuated by said sensor when said sensor senses said carton in said position to thereby selectively position actuate said over-travel assembly preferably via a slide plate on which is mounted a cam element and said actuator is connected to said slide plate.

In another embodiment the push bar includes a means to adjust an effective length of said push bar and said actuator provides said means to adjust an effective length of said push bar.

Preferably, said cut off knife has its cutting edge configured to cut said ribbon beginning at each side edge of said tape ribbon.

Preferably, the applicator further comprises a tape control system comprising a brake pad mounted on a brake assembly pivotably mounted on an application arm of said application roll assembly adjacent to an exit roll over which said tape travels on route to said application roll, and a pressure cam pin mounted on the push bar link in a position to engage said brake assembly when said application roll is moved to said over-travel position to pitch said tape between brake pad and the exit roller.

Preferably, said tape control system comprises a tape path from a source of said tape between as source roll of said tape and said application roller wherein said tape is directed over an entry roll and a one way clutch roll over en route to said application roll assembly and a dancer roller mounted to engage said tape in said tape path between entry roll and said one-way clutch roll and to advance extra length of tape when said application roll assembly is moved to said over-travel position.

Preferably, said tape control system further comprises a stationary extension roller positioned to intersect said tape path between a tape guide roller and said exit roller mounted on said applicator arm when said applicator system is moved to said over-travel position thereby to advance extra tape between said brake pad and a one way clutch roll when tape being pinched by the brake pad.

BRIEF DESCRIPTION OF THE SEVERAL VIEWS OF THE DRAWINGS

Further features, objects and advantages will be evident from the following detailed description of the preferred embodiments of the present invention taken in conjunction with the accompanying drawings in which;

FIGS. 4*a* to 4*h* inclusive illustrates examples of forms of tape applications that may be applied using the present invention.

FIG. 6*a*-1 shows a carton sealed with top and bottom "C"-clip tape.

FIG. 6*a*-2 shows the set-up requirement for C-clip tape application with the cam follower at disengaged position.

FIGS. 6*a*-3, 4, 5, 6, 7 show the sequence of operation for C-clip tape application of the multifunctional tape applicator with cam actuation and set-up requirement as shown on FIG. 6*a*-2.

FIG. 6*b*-1 shows a carton sealed with front and rear L-clip tapes on top and bottom.

FIG. 6*b*-2 shows the set-up requirement for front and rear L-clip tape application with the cam follower at engaged position.

FIGS. 6*b*-3, 4, 5, 6, 7, 8 show the sequence of operation for front (leading) and rear (trailing) L-clip tape application.

FIG. 6*c*-1 shows a carton sealed with only front or leading L-clip tapes on top and bottom.

FIGS. 6*c*-2, 3 show the set-up requirements for front only L-clip tape application.

FIGS. 6*c*-4, 5, 6, 7, 8 show the sequence of operation for front only "L"-clip tape application of the multifunctional tape applicator with cam actuation and set-up requirements as shown on FIGS. 6*c*-2,3.

FIG. 6*d*-1 shows a carton sealed with a discrete section of tape on the top surface.

FIGS. 6*d*-2, 3 show the set-up requirements for application of a discrete sectional of tape.

FIG. 6*d*-4 shows a typical control circuit with two switches or sensor.

FIGS. 6*d*-5, 6, 7, 8 show the sequence of operation to apply a section of tape on the top surface of the carton.

DETAILED DESCRIPTION OF THE INVENTION

Figure 1A:
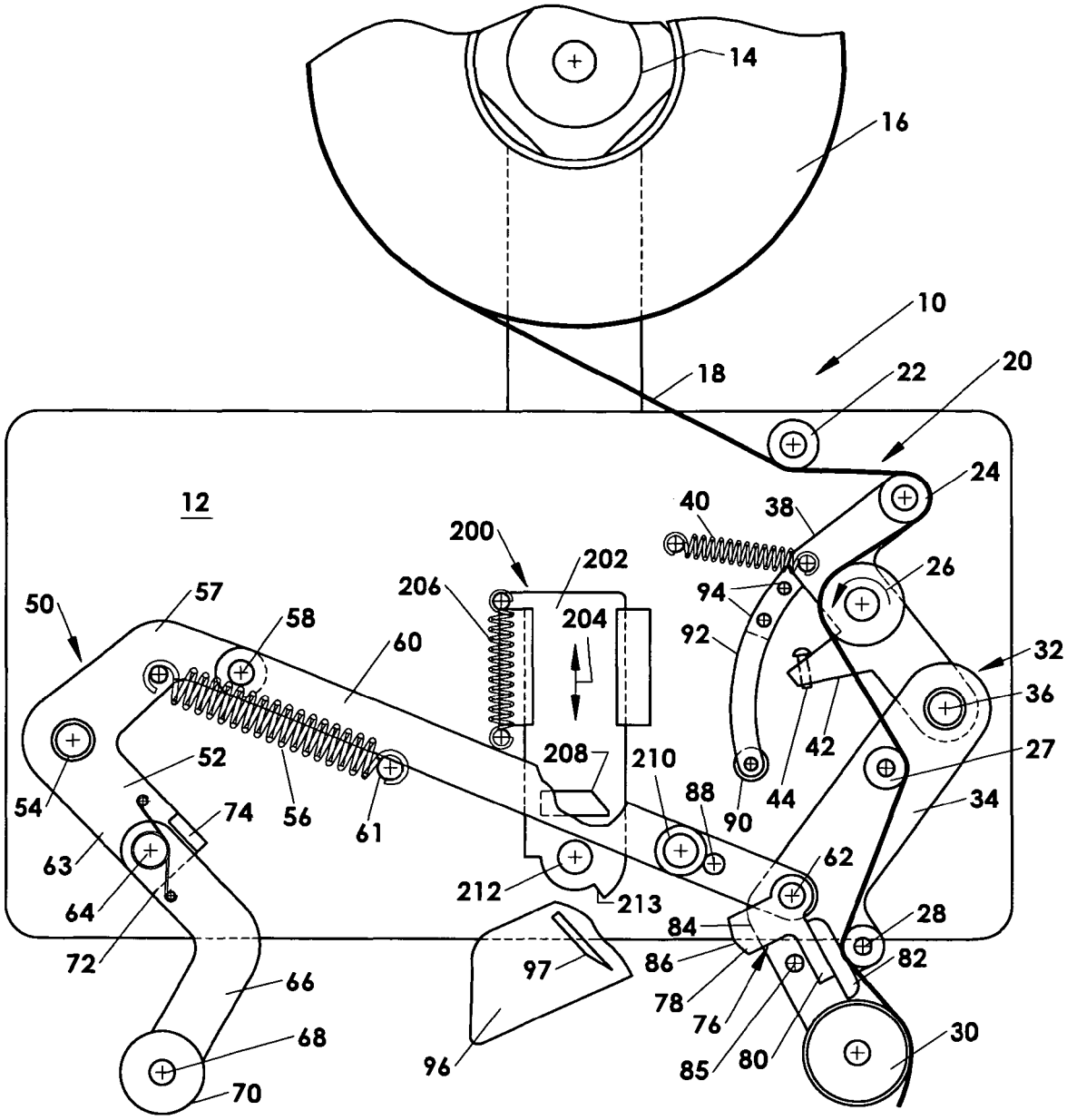
FIG. 1*a* is a schematic illustration with parts omitted for clarity of the multifunctional tape applicator of the present invention.

Turning to FIG. 1*a* the multifunctional tape applicator 10 of the present invention is illustrated with parts omitted for clarity. As shown the applicator 10 is composed of a main frame plate or structure 12 on which the various components and/or assemblies are mounted. A tape support 14 carries a roll of tape 16 from which the tape ribbon 18 is dispensed and travels along the tape path 20 from the roll 14 over an entry guide roll 22, dancer roll 24, one way clutch roll 26 which turns in the direction of ribbon feed from roll 16, a guiding roll 27, exit guide roll 28 to applicator (or application) roll 30.

The application roll or applicator roll assembly 32 is composed of an applicator arm 34 pivotably mounted adjacent to one end thereof on the frame 12 on an axel as indicated at 36 and adjacent to its opposite end i.e. its on the free end the applicator roll 30 is mounted. The guide roll 27 and exit roll 28 are also mounted on the arm 34 as shown in FIG. 1*a* between the pivot mount 36 and the applicator roll 30.

A dancer arm 38 is also pivotably mounted on the frame 12 via the axel 36 and mounts the dancer roll 24 and one way clutch roll 26. The dancer arm 38 is biased to the left as viewed in FIG. 1*a* via the spring 40 connected between the dancer arm 38 and the frame 12. A stop arm 42 projects to the left from arm in FIG. 1*a* and is provided with an adjustable abutment 44 positioned to engage the arm 34 when the application roll assembly 32 is in over-travel position (shown in FIG. 1*d*) as will be described below.

A wipe down assembly 50 is composed of a V-shaped wipe down arm 52 pivotably mounted on the frame 12 via the pivot pin 54 and in the illustration of FIG. 1*a* is biased in a clockwise direction via the spring 56 connected between the arm 52 and the frame 12. This clockwise movement is limited by a pin 61 that engages the link 60 between the side mechanism 200 (to be described below) and the assembly 50. It will be apparent that the stop pin 61 (or its equivalent) serves to stop movement of the wipe down roll 70 (described below) and of the push bar link 60 toward the carton 500 being taped.

A first leg 57 of the arm 52 is pivotably connected as indicated at 58 to one end of a push bar link 60, the opposite end of which is pivotably connected as indicated at 62 to the application arm 34 of the application roll assembly 32. The second leg 63 of the arm 52 adjacent to its free end pivotably mounts as indicted by the pin 64 a wiper roll mounting arm 66 adjacent to one end of the wiper roll mounting arm 66. The arm 66 rotatably mounts as indicated by pin 68 a wipe down or wiper roll 70 adjacent to its free end. The arm 66 is biased in a counter clockwise direction about the pin 64 via a spring 72 one end of which is connected to the arm 63 and the other to arm 66 to releasably hold the arm 66 in abutting relationship with a stop 74 on the arm 63.

A brake assembly 76 is pivotably mounted on the arm 34 via the pin 62 to which the link 60 is connected. The brake assembly 76 is formed by a V-shaped has a brake arm 78 mounted adjacent to the apex of the V-shape on the pin 62 and one leg 80 carries a brake pad 82 adjacent to its free end and the other leg 84 has a cam 86 at its free end. The brake pad 82 cooperates with the exit roll 28 to, when activated, pinch the tape ribbon 18 there between and brake the movement of the ribbon 18. A stop pin 85 cooperates with the side of the leg 80 remote from the brake pad 82 to limit the movement of the brake pad 82 away from the path 20 of the tape 18 i.e. away from the exit roll 28. The cam 86 on the leg 84 cooperates with a pressure cam pin 88 mounted on the link 60 in position to cooperate with the cam 86 when the assembly 32 is in over-travel position (shown in FIG. 1*d*) as will be described below.

A stationary extension roller 90 is mounted on the free end of an extension roller arm 92 the opposite end of which is fixed to the frame 12 as indicated by the bolts 94. The operation of this extension roller 90 will be described below.

Figure 1B:
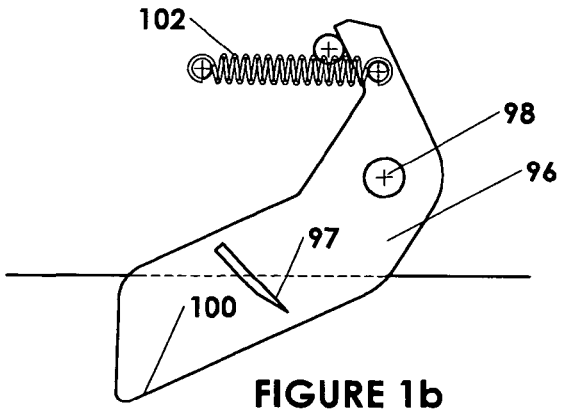
FIG. 1*b* is a more detailed side elevation of a cutting assembly used in the present invention.

A cut off knife assembly 96 (seen FIG. 1*b*) has a knife 97 and is mounted on the frame 12 via a pivot pin 98. A cam surface 100 is provided on a free end of the knife assembly which is engages the adjacent surface of a carton being taped to hold the cut off assembly against the pressure of spring 102 to hold the knife assembly 96 and thereby the cut off knife in an elevated position to cut the trailing end of a leading L-clip when a L-clip taping is being done and yet be free when the cam surface 100 clears the adjacent surface of the case being taped to be moved by the spring to cut the tape after the trailing L-clip (or the C-clip) has been completed.

Figure 1C:
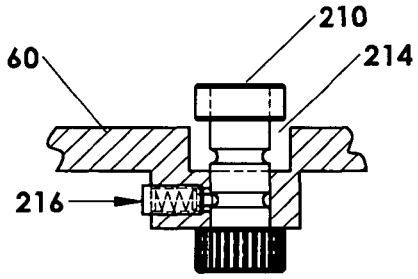
FIG. 1*c* is a section through the cam follower showing the follower in operative position and illustrating its ability to be moved between an operative and an inoperative position
Figure 1D:
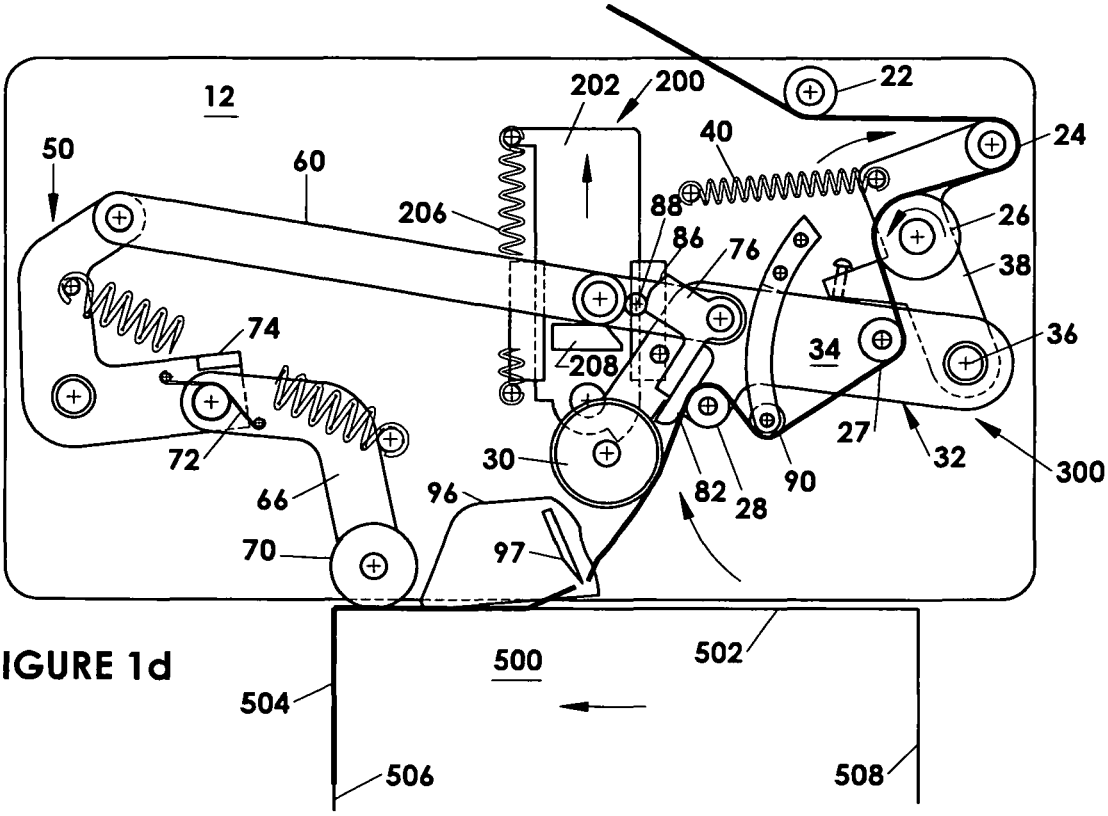
FIG. 1*d* is a schematic illustration with parts omitted showing the applicator in the over-travel position in tape cutting of the first L-clip to a carton.

Part of the mechanism 200 to move the application assembly to over-travel position shown in FIG. 1*d* is shown in FIG. 1*a* (the actuators for the so moving the application assembly are illustrated in FIGS. 2 and 3 and will be described below). The part of mechanism 200 shown in FIG. 1*a* includes a slide plate 202 slidably mounted on the frame 12 as indicated by the arrow 204 and is biased toward the carton being processed by the spring 206. The slide plate 202 has fixed to it a cam plate 208 that is positioned to engage with a cam roller 210 mounted on the link 60 when the application arm assembly 32 is moved to over-travel position. A pin 212 connects the slide plate 202 to the activation cams shown in FIG. 2 and a suitable cam stop 213 is provided to stop the activating cam 400 as will be described below.

The cam roller 210 is moveable between an active engaging position shown in FIG. 1*c* wherein the roller 210 extends from one side of the link 60 and an inoperative or retracted position wherein the roller 210 is received within the pocket 214. A suitable detent pin is used to hold the roller in the selected position. When the roller is in active position it will engage with the cam plate 208 and be carried with the slide as it is moved away from the carton being processed thereby to move the application system to its over-travel position as shown in FIG. 1*d*.

Turning now to FIG. 1*d* the applicator assembly 32 is shown in over-travel position 300. In this position the slide plate 202 has been moved away from the carton 500 being processed via a mechanism or system yet to be described thereby moving the cam plate 208 and thus the roller 210 and thereby the link 60 in the same direction. This movement of the link 60 pivots the assembly 32 further clockwise around the axel or pivot pin and lifts the applicator roll 30 well clear of the adjacent surface 502 of the carton 500 to provide clearance there between as is evident from FIG. 1*d*. Movement to the over-travel position 300 causes several thing to happen, namely: abutment 44 engages the arm 34 thereby moving the arm 38 and the dancer roller to extend the tape path and thus provide slack in the tape when the application assembly is moved from over-travel position; the cam 86 of the brake assembly engages the pressure cam pin 88 to clamp the tape between the pad 82 and the exit roller 28; the extension roller 90 traverses the normal path of the tape 18 and extends the length of tape between the guide roll 27 and the exit roll 28 to further provide slack in the tape 18; and the tape ribbon 18 is brought in contact with the knife 97 and is cut.

Figure 1E:
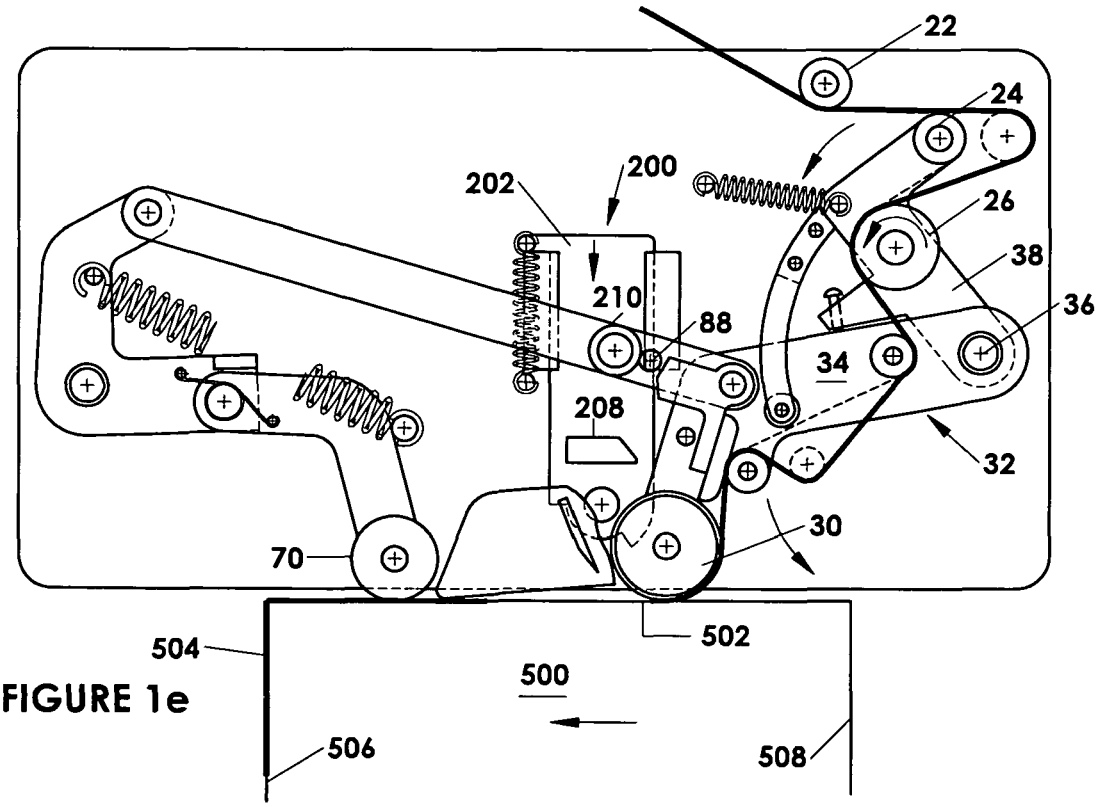
FIG. 1*e* is a schematic illustration with parts omitted showing the applicator in an advanced position relative to FIG. 1*d* and applying a lead end of a second L-clip to a carton.

Next the mechanism 200 is moved from over-travel position 300 retracting the dancer roll releasing the brake 80, allowing the extension roll 90 to stay back to the other side of the tape path and the tape (roll 30) away from the knife 97. This movement from the over-travel position 300 moves the roll 30 and thereby the free end of the tape 18 against the adjacent surface 502 of the carton 500 to attach the next length of tape to the adjacent surface of the carton (see FIG. 1*e*). Normally this next length of tape will form the trailing L-clip.

It will be apparent that the leg leading L-clip 504 applied to the leading face 506 of the carton 500 is applied by the application roll 30 in the conventional manner and that the leg of the trailing L-clip that extend along the trailing face 508 of the carton is wiped down via the wipe down roll 70 in the conventional manner as is the tape extending from this leg severed by the cut off mechanism 96.

It will be apparent that it is desirable to have the wipe down roll 70 in engagement with the tape on the adjacent face 502 of the carton 500 when the application assembly is in the over-travel position 300. This is obtained in the FIG. 1*a* embodiment by the spring 72 moving the arm 66 away from the abutment 74 to force the roll 70 toward and against the surface 502 even when the movement to the over-travel position would tend to move the roll 70 away from the surface 502.

Figure 1F:
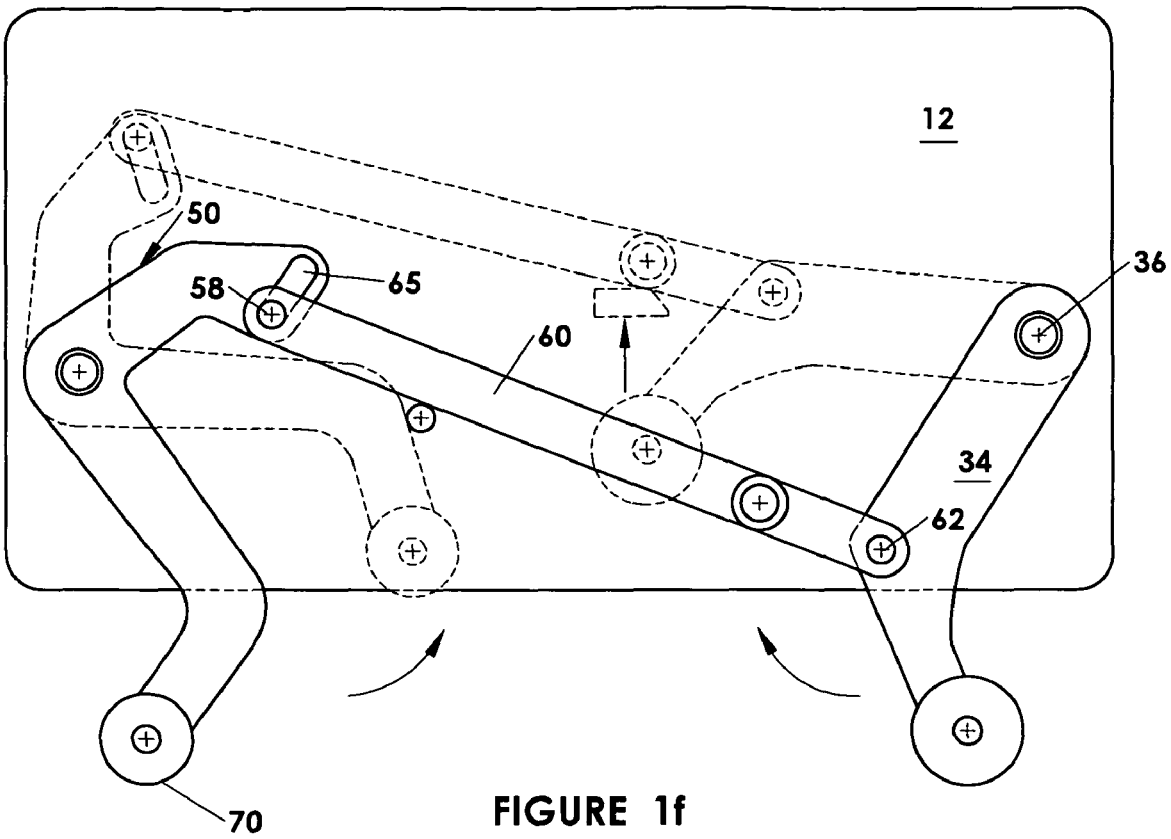
FIG. 1*f* is a schematic illustration showing the positions of the applicator roll and wipe down roll during operation of the applicator and illustrating the use of a pin and slot interconnection between the push bar link and the application and wipe down assemblies.
Figure 1G:
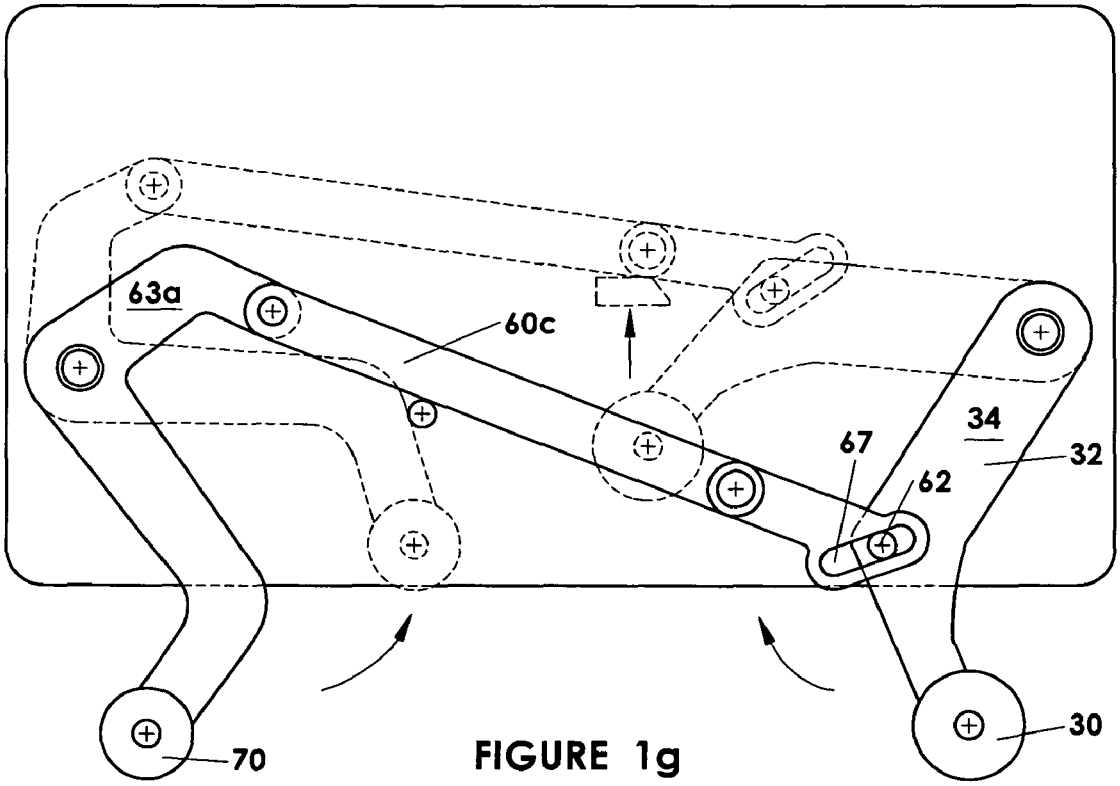
FIGS. 1*g*, 1*h*, 1*i*, 1*j* and 1*k* illustrate several forms of interconnections by various forms of push bar links between the application assembly and the wipe down assembly to accommodate movement to the over-travel position of the application assembly.
Figure 1H:
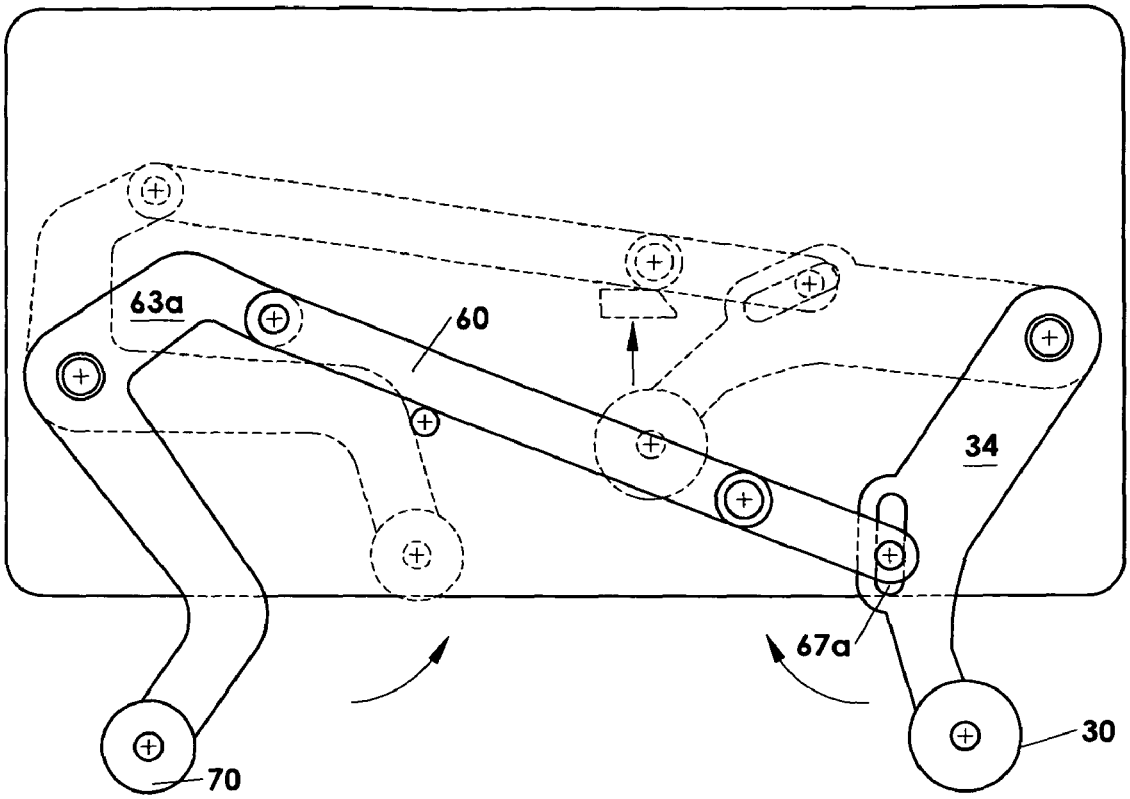
Figure 1I:
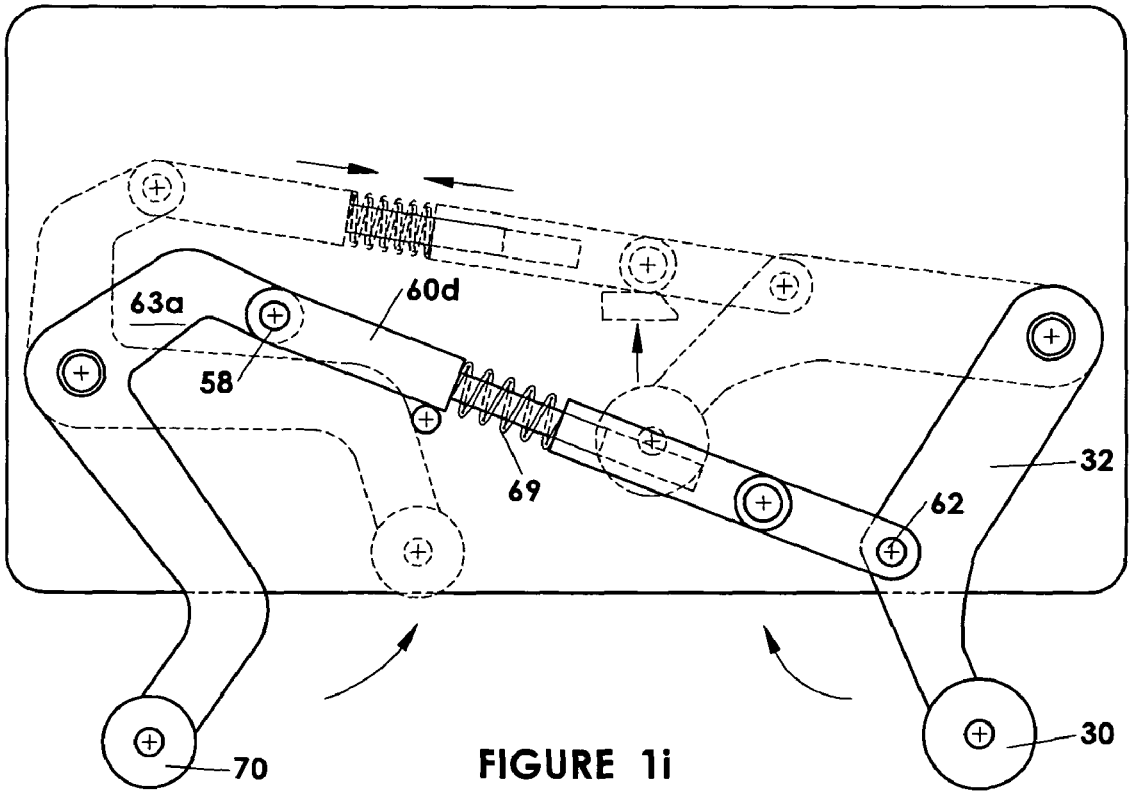

The push bar link 60 may take a variety of different forms to accommodate movement of the application assembly 32 into over-travel position 300 while maintaining the wipe down roll 70 in the required position. Some alternatives are shown in FIGS. 1*f* to 1*h*. In FIG. 1*f* the pin 58 is received in a slot 65 which permits lost motion between the link 60 and the assembly 50. In FIG. 1*g* a slot 67 is provide at the end of link 60*c* (equivalent to link 60) adjacent to the assembly 32 and cooperates with the pin 62 to provide the lost motion connections alternatively the pin 62 could be fixed to the end of link 60 and the slot 67*a* be provided in the arm 34 to achieve the same result (see FIG. 1*h*). In FIG. 1*i* the link 60 has been replaced by an expandable link 60*d* biased to expanded position by the spring 69 and compressed baby movement of the assembly 32 to the over-travel position 300.

Figure 1J:
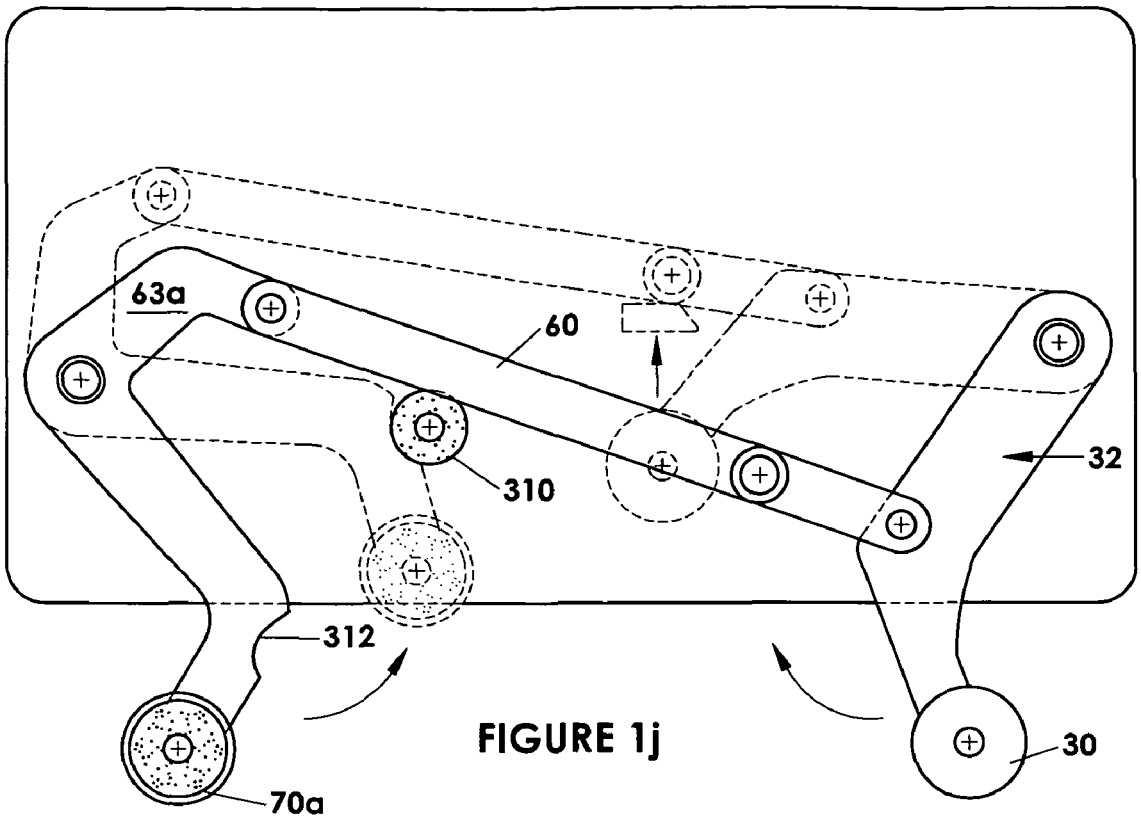
Figure 1K:
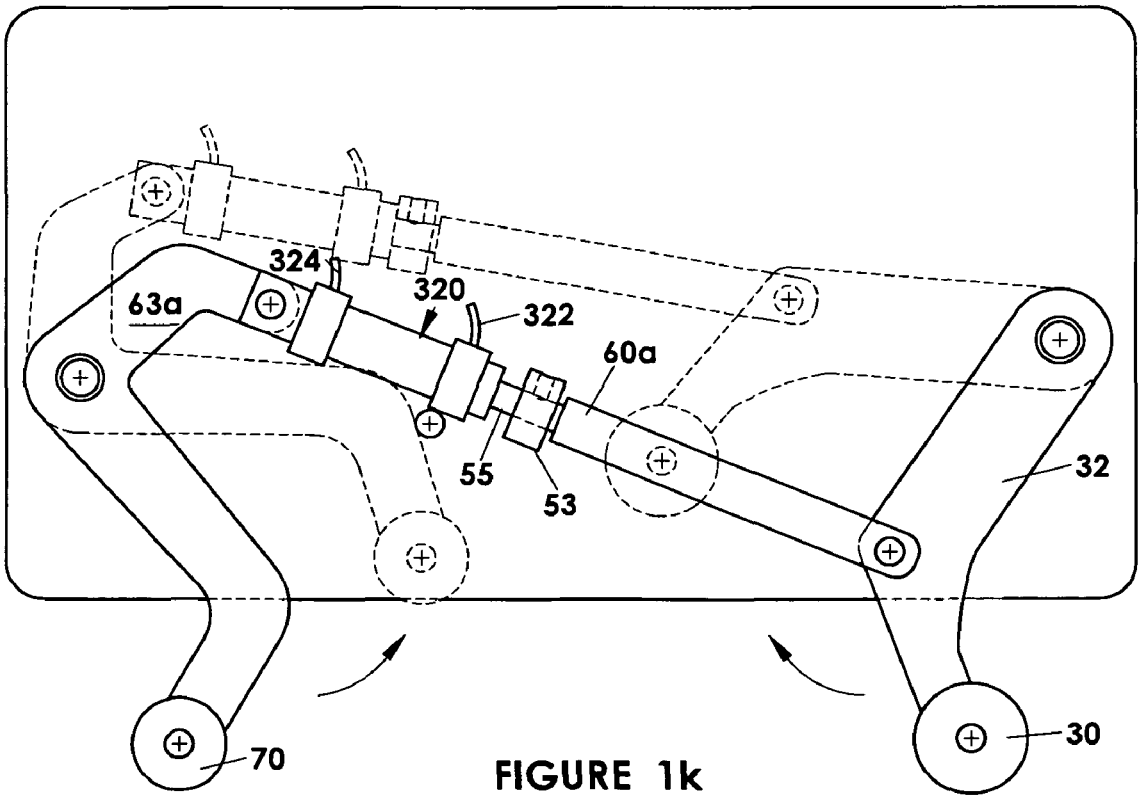

The action of keeping the roll in contact with the surface 502 when the application assembly is in the over-travel position 300 may be achieved in a variety of different ways examples of which are shown in FIGS. 1*j* and 1*k*.

In FIG. 1*j* this is achieved using a one piece arm 63*a* wherein the arms 63 and 66 are integrated and the pressure toward the surface 502 is obtained by a compressible stop 310 that engages the pocket 312 in the arm 63*a* when the roller 70 is contacting the surface 502 of a carton to resiliently urge a compressible roll 70*a* that replaces roll 70 against the surface 302. In the solid line position the roll 310 acts as a stop replacing the stop pin 61 of FIG. 1*a* and in the dash line position engages in the pocket 312 to hold the roll 70*a* against the surface 502. If desired the stop 61 need not be replaced i.e. the roll 310 need not act as a stop in the solid line position and the position of a stop such as pin 61 may be selected as required.

In FIG. 1*k* the push bar link 60 has been replace by a contractible (or extendable) push link 60*a* that includes a variable length actuator 320 that preferably is a pneumatic cylinder with operating air connections 322 and 324 to contract or extend it's length as required. In the solid line position shown in FIG. 1*k* the actuator 320 is expanded and in the retracted position shown in dash lines which corresponds with the over-travel position 300 its length is contracted. Suitable sensors will be provided to sense the position of the carton 500 and activate the actuator 320 to move the system to and from the over-travel position (shown in dash lines) at the appropriate times. A lock collar 53 is normally, secured on the cylinder rod 55 to allow the cylinder to retract to cause over-travel action for tape-cutting or L-clip taping, it can also be used to prevent the over-travel action by re-locating its lock position at the extended position for C-clip tape application, which does not require any air actuation or over-travel action as long as the cylinder is maintained at extended position.

Figure 1L:
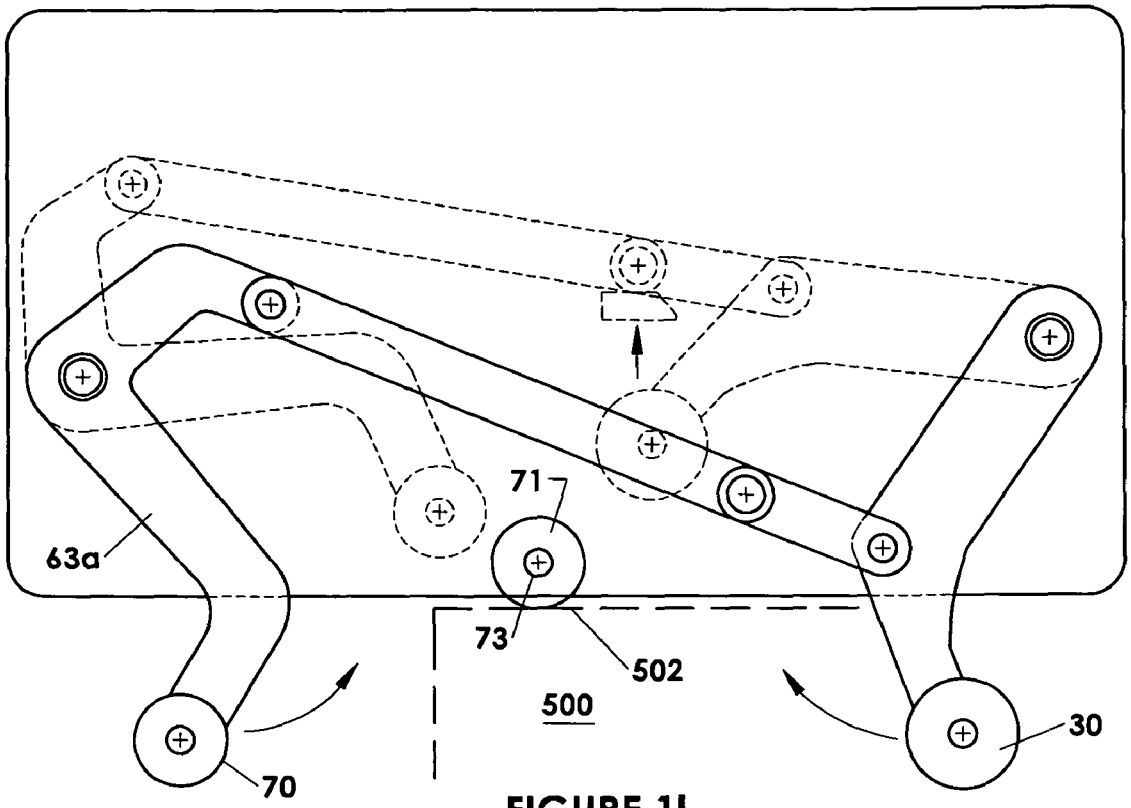
FIG. 1*l* illustrates a method of using a fixed roller to provide the function of the wipe-down roll at over-travel position.

1*l* illustrates another embodiment using a one piece wipe down arm 63*a* similar to that of FIG. 1*j*. In the FIG. 1*l* the roll 70 is moved well above the surface 502 to the dash line position illustrated so that the roll 70 does not press onto the surface 502. The tape is instead held against the surface by compressible roller 71 rotatably mounted on the frame 12 on an axel 73. The one piece arm 63*a* is free to move with the over-travel movement but still is provides the function of wiping down the tail end of the tape onto the tailing face 508 (see FIG. 1*d*) of the carton 500. In this embodiment the stop pin 61 has been removed to allow the wipe down link to move away from the adjacent surface 502 of the carton 500. Generally a stop pin (not shown) will be provided at a convenient position to limit movement of the roll 30 and 70 as required to facilitate operation.

Figure 1M:
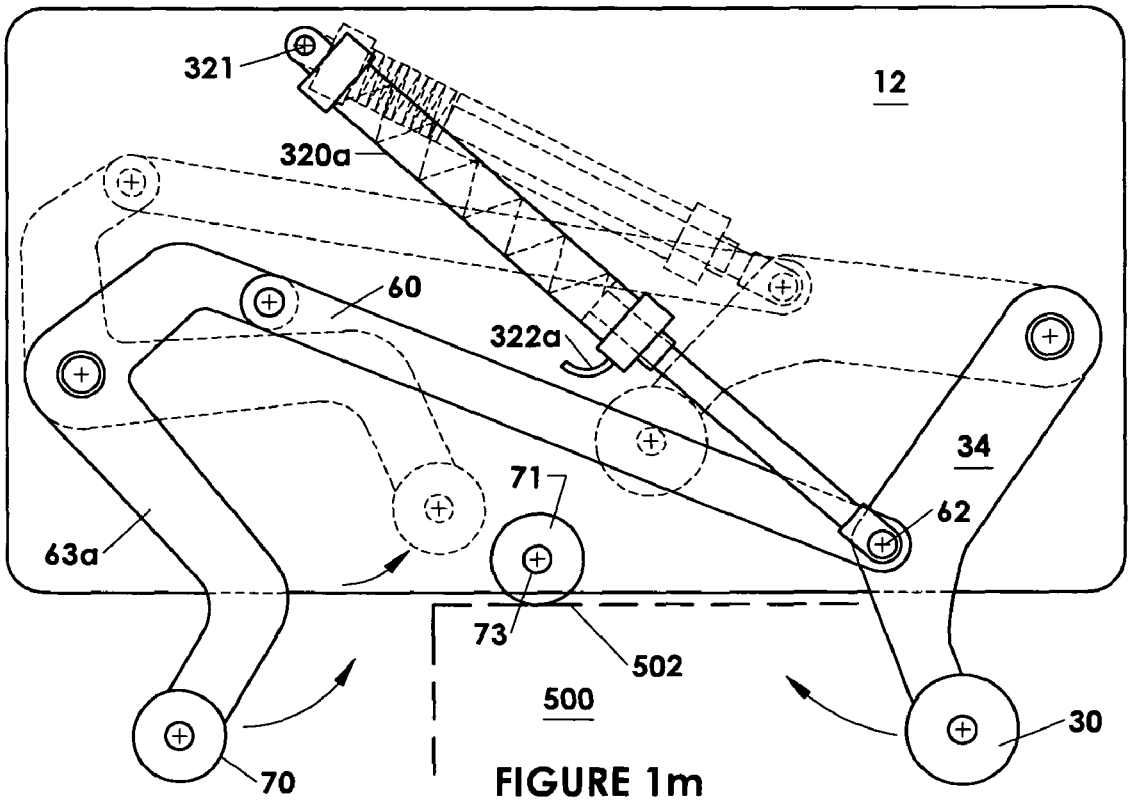
FIG. 1*m* shows a fixed roller similar to FIG. 1*l* and an over-travel linkage with a single-acting normally extended, spring-return air cylinder.

FIG. 1*m* shows yet another activating system activated by sensors in the same manner as described above with respect to FIG. 1*k* but in FIG. 1*m* the cylinder 320 is replaced by a similar cylinder 320*a* one end of which is connected to the pin 62 connecting the arm 34 and link 60 and its opposite end to a pin 321 mounted on the base 12. If preferred the one end may be connected to the link 32, the wipe down link 63*a* or the push bar 60 as deemed suitable. The cylinder 322*a* is activated in the same manner as cylinder 320 to move the assembly 32 to the over-travel position 300 at the appropriate time.

Figure 2A:
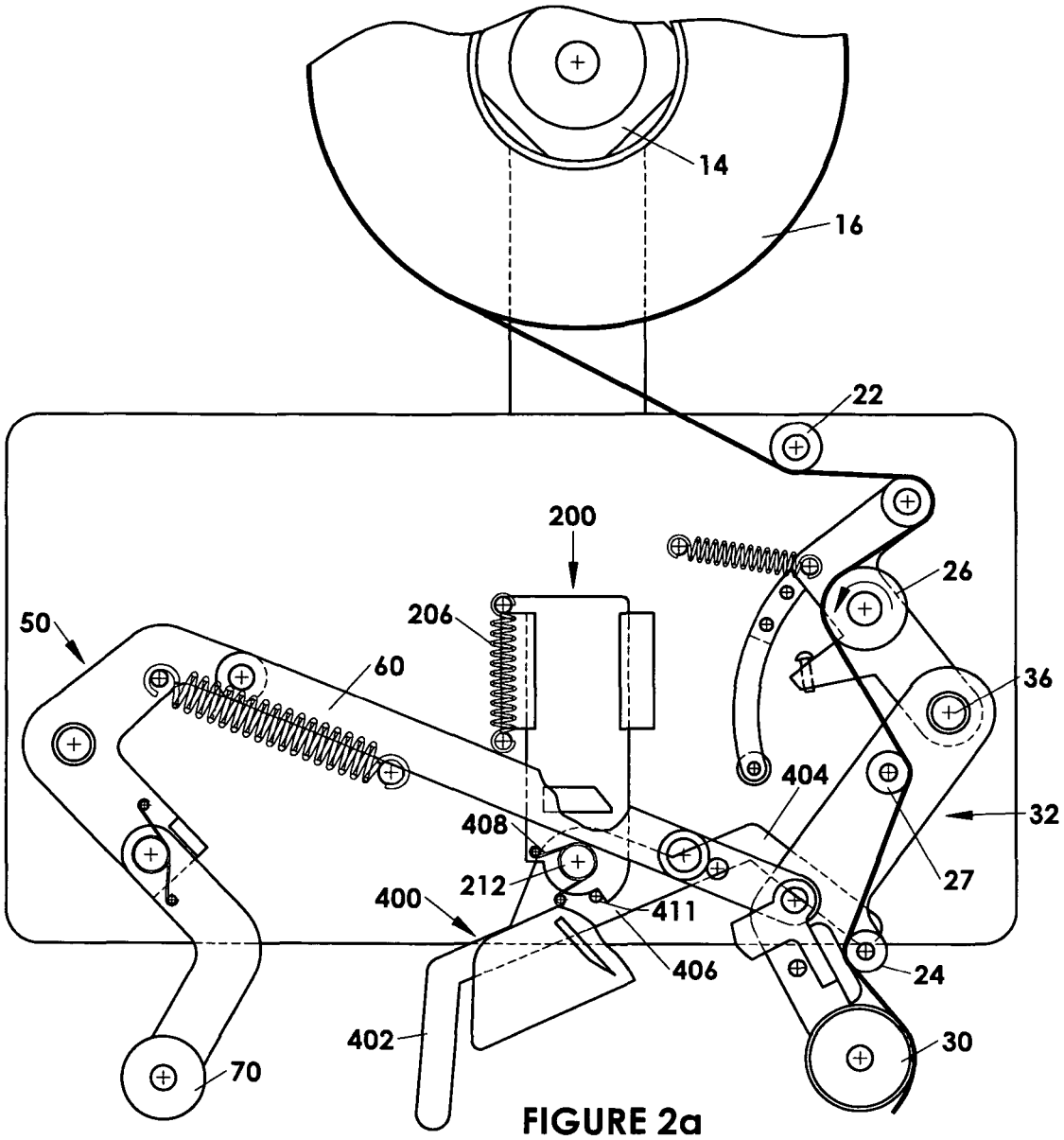
FIG. 2*a* is a view similar to FIG. 1*a* but showing one form of applicator cam.
Figure 2B:
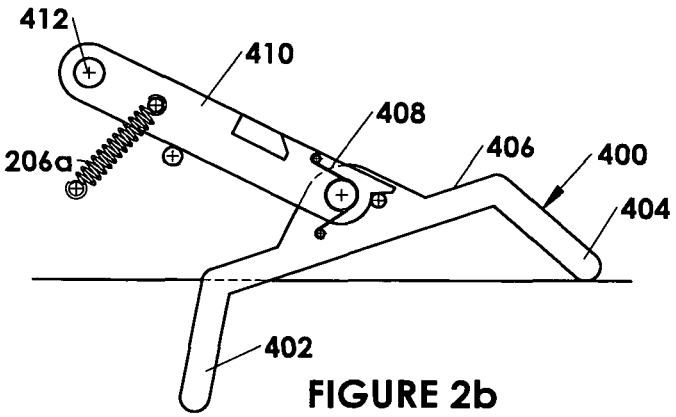
FIG. 2*b* is a side elevation view showing a modified form of actuator cam.

FIGS. 2*a* and 2*b* show a simple form of actuator cam 400 in the form of a substantially U-shaped cam element having a front face engaging leg 402 adapted and positioned to engage the leading face (leading edge 501 as will be described below) of a carton 500 to be taped and a trailing leg 404 interconnected by a bridging section 406. In FIG. 2*a* the actuator cam is pivotably connected to the slide 202 described above and shown in FIGS. 1*a*, 1*d* and 1*e* and moves the cam against the spring as the leg 402 moves over the leading face 504 to the adjacent face 502 of the carton 500 while the end of the other leg is supported by the adjacent face 502 thereby to move the slide away from the adjacent face 502 and thereby move the applicator assembly 32 to the over-travel position as above described. A spring 408 biases the cam element 400 so that the stop pin 411 tends to engage stop cam 213 on the slide plate 204 and the leg 402 extends the farthest away from the frame 12 when in the rest position before a carton 500 is fed to the taper 10.

In the FIG. 2*b* embodiment the slide 202 has been replaced by a lever 410 one end of which is pivotably mounted on the frame 12 via the pin 412 and the other is pivotably connected to the cam 400 in the same manner as the slide was connected thereto. The cam plate 208 is mounted on the lever 410 and interacts with the cam 210 as above described. A suitable spring 206*a* replaces the spring 206.

Figure 2C:
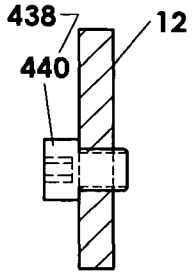
FIG. 2*c* shows a screw-in stop pin to be used for applying a single front only "L"-clip tape on the carton with the cam actuator tape applicator as illustrated in FIG. 6*c*.

FIG. 2*c* shows a removable pin two of which 438 and 440 will normally be used depending on the configuration and what is to be applied to the carton. One pin namely the one shown at 438 is screwed into the base plate 12 of the tape applicator 10 below the actuating cam tailing leg 404 to restrict its swing-down movement and thereby maintain the application assembly in the over-travel position until the carton discharged completely off the cam when only a leading L-clip is to be applied i.e. without the rear L-clip applied (see FIG. 6*d*(1). The second pin 440 when used is screwed into the base 12 and is positioned in a hole 442 through the cutting blade cam 96 to hold the cutting knife assembly 96 in depressed position as shown in FIG. 6*d* when only a strip is being applied to the face 502 using the sensor and solenoid system See FIG. 3*a* to control the applicator 10 as will be described with respect to FIG. 6*d*.

Obviously when the stop pins 438 and 440 are removed the device will function as shown in FIGS. 2*d* to 2*g*.

Figure 2D:
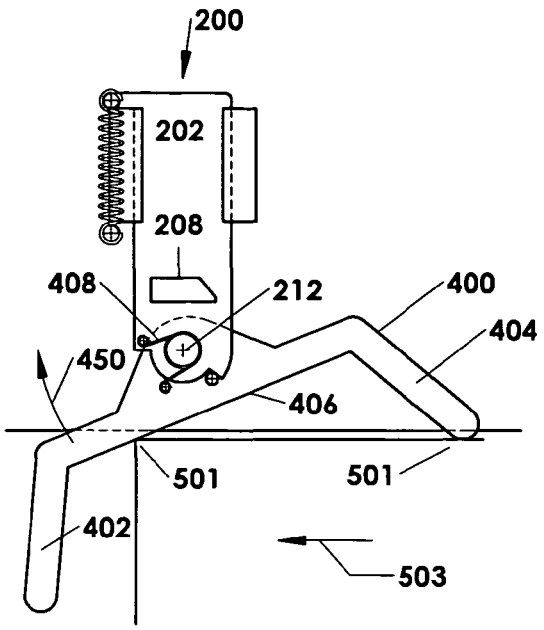
FIGS. 2*d*, 2*e*, 2*f* and 2*g* illustrate the operation of the actuator cam with the travel path of a carton, with FIG. 2*g* illustrating the cam returned to home position ready for the next carton.
Figure 2E:
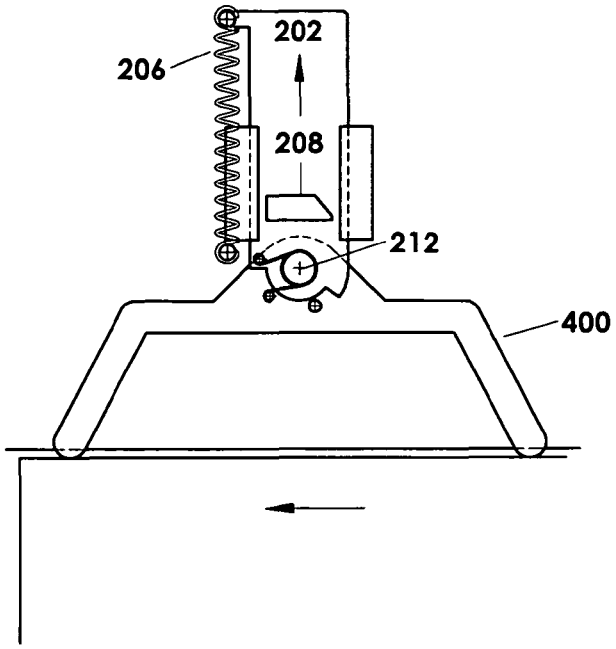
Figure 2F:
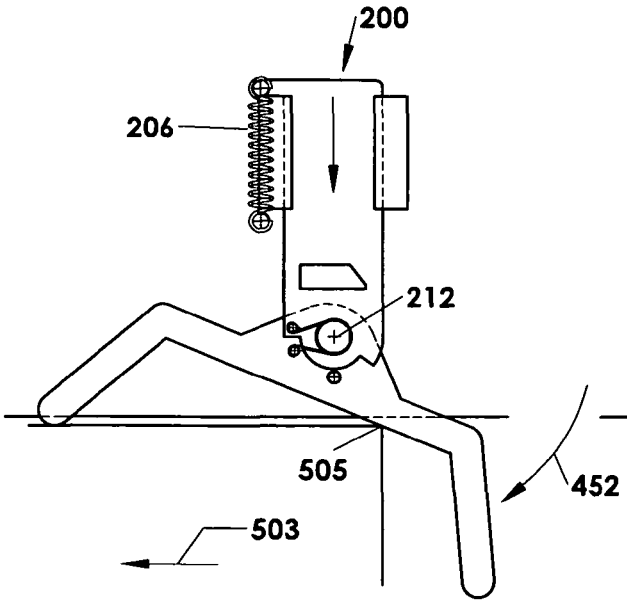
Figure 2G:
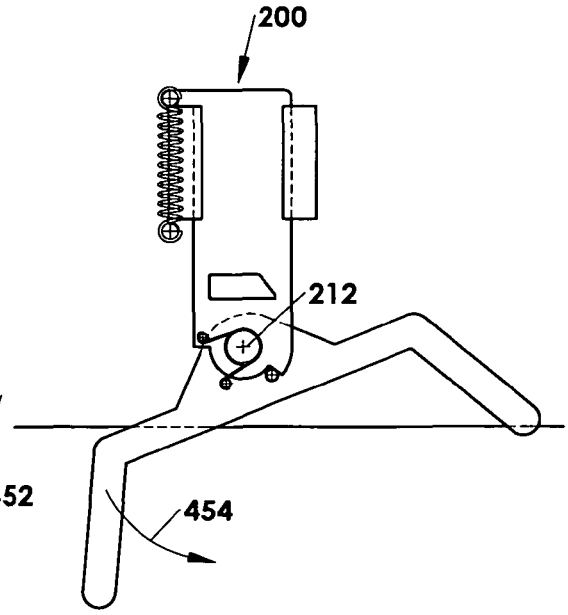

FIGS. 2*d* to 2*g* illustrate the sequence, first as shown in FIG. 2*d* the cam 400 is turned clockwise as indicated by the arrow 450 by engagement with the leading edge 501 of the carton 500 traveling in the direction indicated by the arrow 503. When the leading face engaging leg 402 rides onto the adjacent surface 502 of the carton 500 and the trailing leg 404 is also resting on this surface 502 the slide mechanism 200 and applicator assembly 32 are in over-travel position 300 and the spring 206 is extended (see FIG. 2*e*). When the trailing leg 404 clears the trailing corner 505 the spring 206 drives the slide 202 toward the adjacent face 502 of the carton and the cam 400 is turned clockwise as indicated by the arrow 452 and after the carton 500 has passed the cam 400 the spring 208 rotates the cam 400 about the pin 212 and back to starting position as shown in FIG. 2*g*.

Figure 2H:
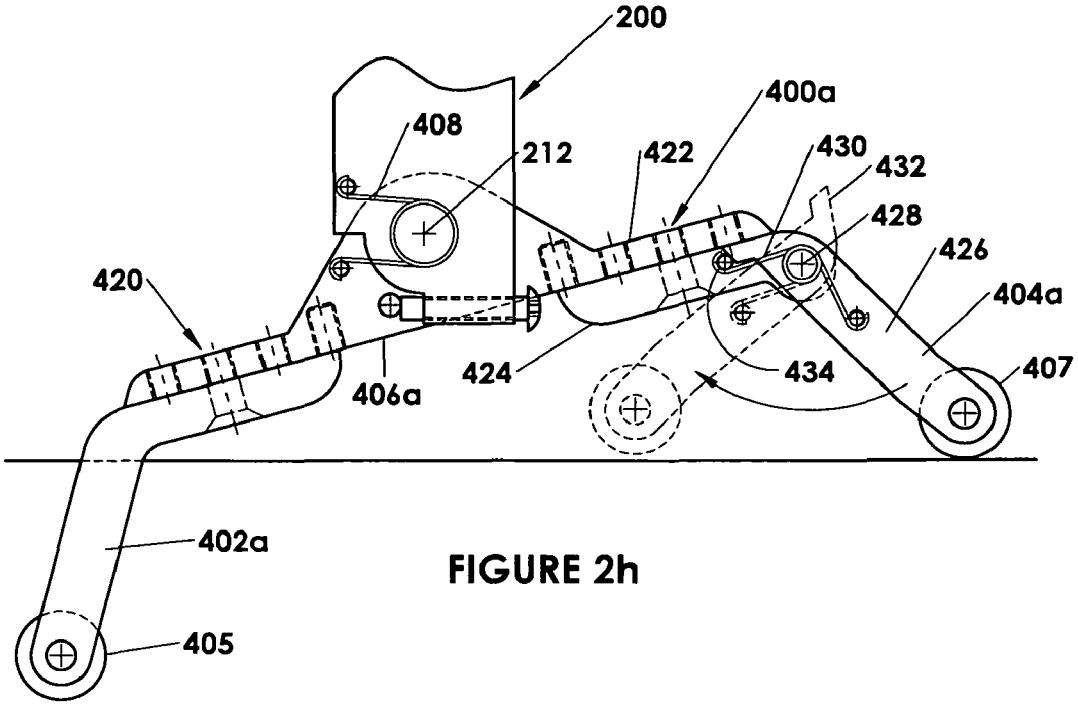
FIG. 2*h* illustrates a cam with individual legs

In FIG. 2*h* the simple U-shaped cam 400 has been replaced with a more complicated U-shaped cam which is made up of separate components namely the leading face engaging leg 402*a* which is bolted to a discrete bridging section 406*a* with selectable mounting holes for tape length adjustment as indicated at 420 and similarly the trailing leg 404*a* is connected to the bridge 406*a* with selectable mounting holes for tape length adjustment as indicated at 422. The selectable mounting holes systems 420 and 422 permit selective adjustment of lengths of the legs 402*a* and 404*a* to permit adjustments so that different tape lengths may be applied to form front and rear "L" clip tapes along on adjacent side 502 of a carton 500.

The legs 402*a* and 404*a* are each provided at their free ends with their respective rollers 405 and 407 to reduce friction when riding on the surface 502 of a carton 500.

The trailing leg 404*a* is made of two separate parts a mounting portion 424 and a caming portion 426 pivotably interconnect by pivot pin 428. The portions 426 and 428 are biased toward each other via spring 430 one end of which is connect to portion 424 and the other to portion 426. A stop 432 formed at the end of the portion 426 adjacent to the pivot pin 428 engages with a stop pin 434 on the portion 424 to limit opening movement of the portion 426 relative to the portion 424. With the portion 426 in the solid line position shown in FIG. 2*h* the cam 400*a* is operative to move the application roll assembly to the over-travel position. The trailing leg 404*a* moves to the collapsed position shown in dash line position if another carton arrives before the completion of the current taping cycle to prevent carton jamming. The spring 430 is sufficiently strong to maintain the leg 404*a* in the solid line position unless force by an errant carton into the dash line position.

Figure 2I:
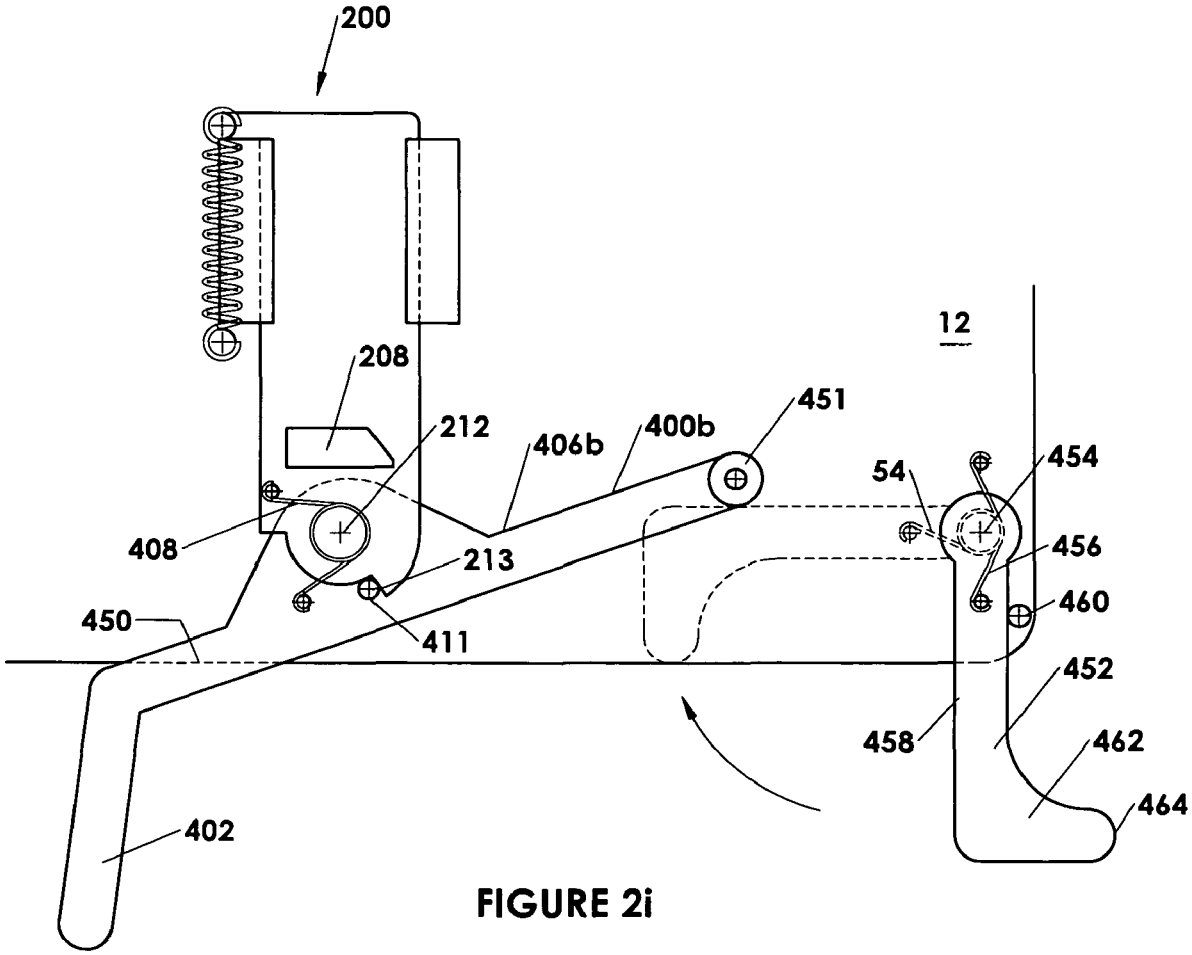
FIG. 2*i* shows an alternative actuator cam structure with a two part cam.

FIG. 2*i* shows an alternative two part actuator cam structure 400*b* with cam one part composed of the leading leg 402 and a modified bridging section 406*b* that is extended to form an leading L-shaped member 450 and the trailing leg 404 is eliminated and replaced by a roller 451. The spring 408 biases the L-shaped member 450 so that the stop pin 411 thereon engages a cam stop 213. A second "L" shape cam 452 is pivoted on the front of the base plate 12 via pivot pin 454 and a spring 456 biases a first arm 458 of the cam 452 against a stop pin 460 on the base 12. The second arm 462, in rest position with arm 458 against stop 460, is positioned to engage the leading face of the next carton to be taped and is rotated clockwise by the incoming carton and then the end of the second arm 462 and the rounded tip 464 of the arm rides on the surface 502 of the carton 500 being processed. In this position the roller 451 rides on the arm 458 (as shown in dash lines) and hold the application assembly in the over-travel position. The second cam 452 serves as the collapsible leg in carton jamming prevention.

Figure 3A:
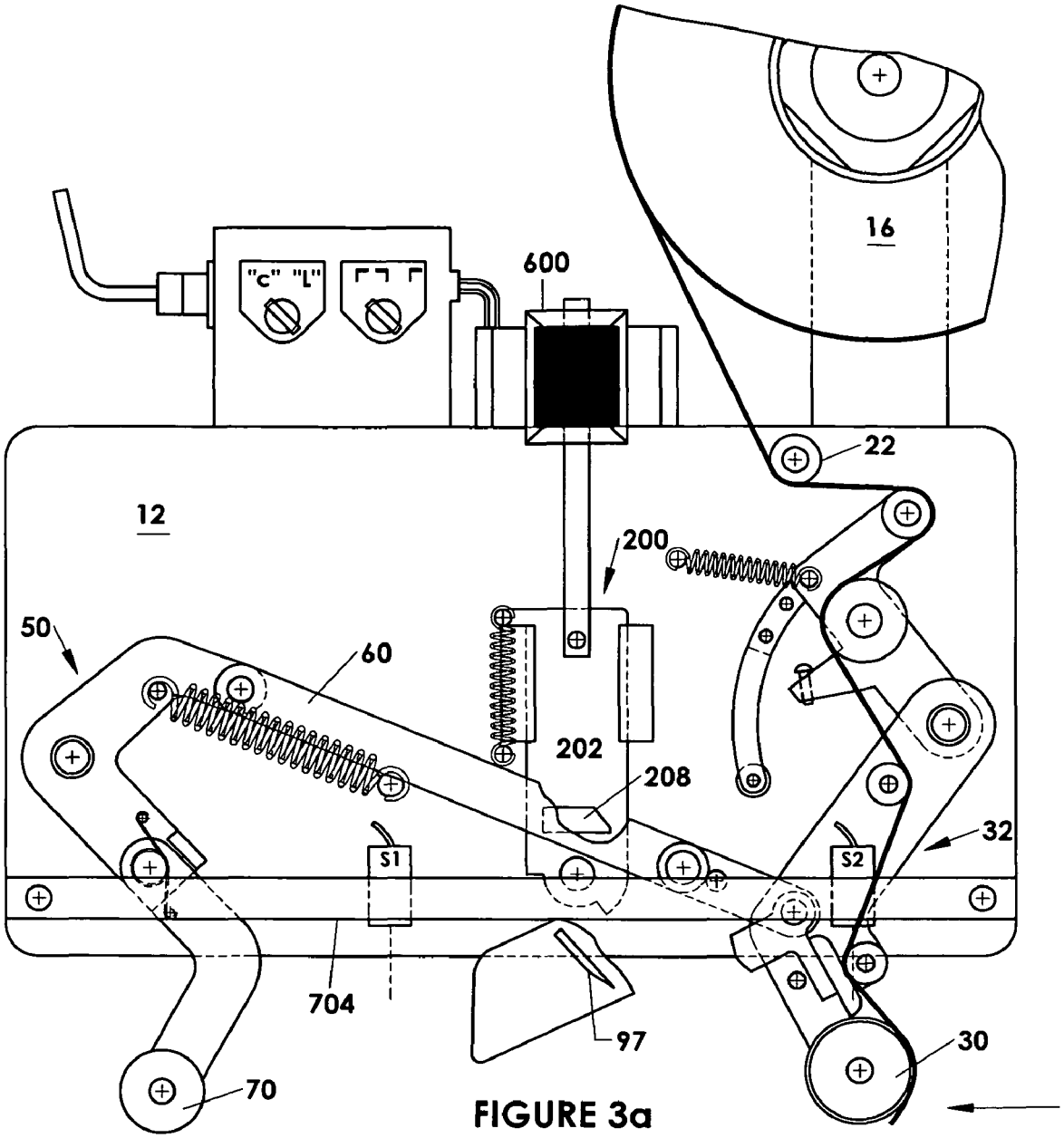
FIG. 3*a* schematically illustrates a multi-functional tape applicator with solenoid type actuator and sensors to activate in place of the mechanical system employing the actuator cam.

In the FIG. 3*a* embodiment the cam 400 has been replaced by sensors S1 and S2 and a solenoid actuator 600 that is actuated and deactivated by the solenoids S1 and S2 which sense the carton 500 as it is passed by the actuator or taper 10 to operate the solenoid 600 as required.

Figure 3B:
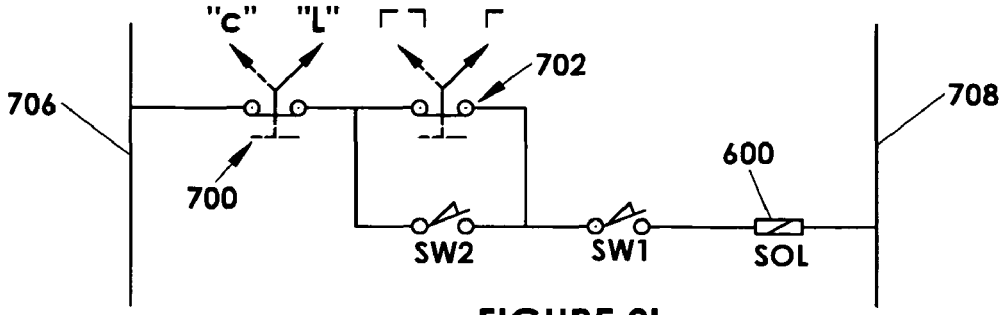
FIG. 3*b* is a schematic wiring diagram for the system shown in FIG. 3*a*. Limit switches contacts are being shown for simplicity reason.

FIG. 3*b* shows an electrical control circuit with three different selectable taping configurations with two 2-positions selector switches: as shown with the first switch 700 open to cut off the power supply-as shown in dash lines the system will produce C-clip taping. With switch 700 closed as shown in solid line and second switch 702 open as shown in dash lines in FIG. 3*b* leading and trailing L-clip will be produced and with switches 700 and 702 both closed, only the front or leading L-clip will be produced.

The control circuit consists of: in-put devises of selector switches 700 and 702; limit switches with normally open contacts or sensors (SW1 for S1 and SW2 for S2 in FIG. 3*b*) and the out-put of a solenoid 600 as indicated and shown by standard electrical symbols. In simple terms, the switches and the solenoid are wired to a series circuit between the two power lines are indicated at 706 and 708.

S2 is positioned to the front of the tape applicator 10; S1 is position to the down stream of the tape applicator 10. Their positions can be adjusted on the bar 704 to achieve different tape length for the front and rear L-clip tape lengths on surface 502 of the carton as required. They are mounted in equal distance between the cutting blade 97 for equal tape length, and the distance measuring from the cutting blade 97 to each switch is directly proportional to the resulting tape length applied onto the top of the carton.

Figure 3C:
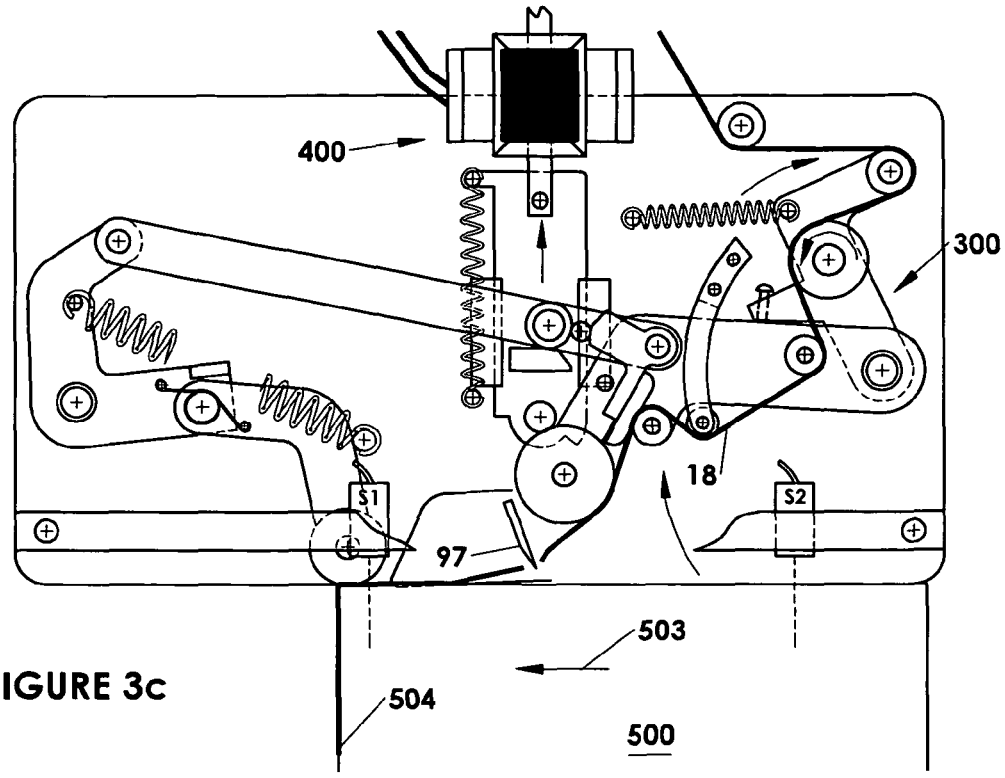
FIG. 3*c* illustrates the multi-functional tape applicator with solenoid and sensors actuated to perform the tape cutting action for the front or leading L-clip tape.

FIG. 3*c* shows the applicator after the sensor S1 has detected the carton 500 and energized the solenoid 600 to the over-travel position 300 illustrated wherein the tape 18 will be cut off by the knife 97, and also illustrates the tape braking/tension control movement at over-travel position as described above.

Figure 3D:
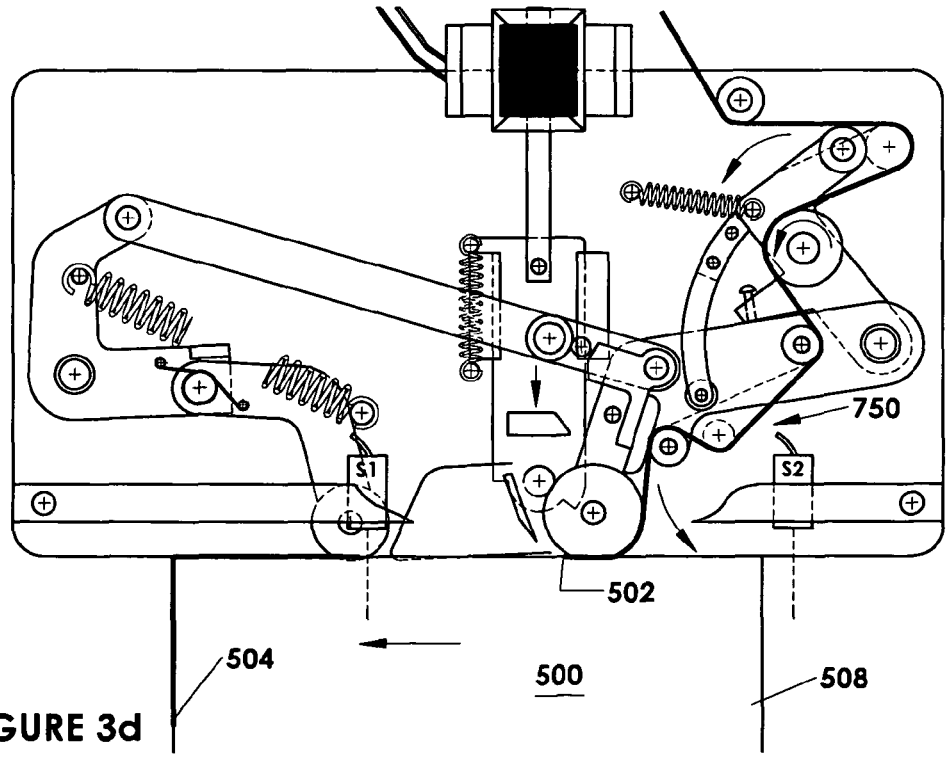
FIG. 3*d* illustrates the rear or trailing L-clip tape application action after the tape-cutting action for the front L-clip as illustrated by FIG. 3*c*.

FIG. 3*d* illustrates the position of the various parts of the applicator 10 at the commencement of the application of the trailing L-clip tape application action that follows the tape-cutting action for the front "L" clip as illustrated by FIG. 3*c* when both leading and trailing L-clips are being applied to the carton. The sensor S2 senses the passing of the rear or trailing side 508 of the carton 500 and activates the sensor S2 to de-energize the solenoid 600 causing the release from the over-travel position and the roll 30 to apply the rear L-clip tape to the surface 502. This figure also shows the loose tension condition of the tape provided for easy adhesion contact onto the carton opposite the arrow 750.

FIGS. 4*a* to *h* show some of the variations of tape application that may be done using the present invention. FIG. 4*a* illustrates the most common case sealing arrangement wherein a C-clip tape 520 is applied to the top and the bottom of carton 500. FIG. 4*b* shows a leading L-clip 522 and a trailing L-clip 524 applied to a carton 500 (both top and bottom). FIG. 4*c* shows leading L-clips 522 to the top and bottom and no trailing L-clips while FIG. 4*d* shows to trailing L-clips and no leading L-clips being applied. FIG. 4*e* shows a C-clip applied to one side (top or bottom) and leading and trailing L-clips. FIG. 4*f* shows leading and trailing L-clips 522 and 524 respectively applied to one side (top) and a C-clip to the bottom of a different form of carton. FIG. 4*g* illustrates the use of a pair of leading L-clips and tailing L-clips 522 and 524 applied to yet another form of carton and FIG. 4*h* shows the application of discrete spaced apart tape patches 526, 528 and 539 applied to the same face of a carton.

Figure 5C:
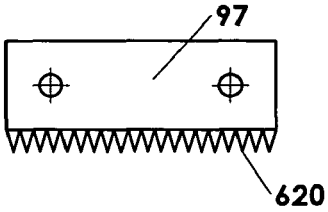
FIGS. 5*c*, 5*d* and 5*e* illustrate different cut off knife configurations that are recommended for use in this invention.
Figure 5A:
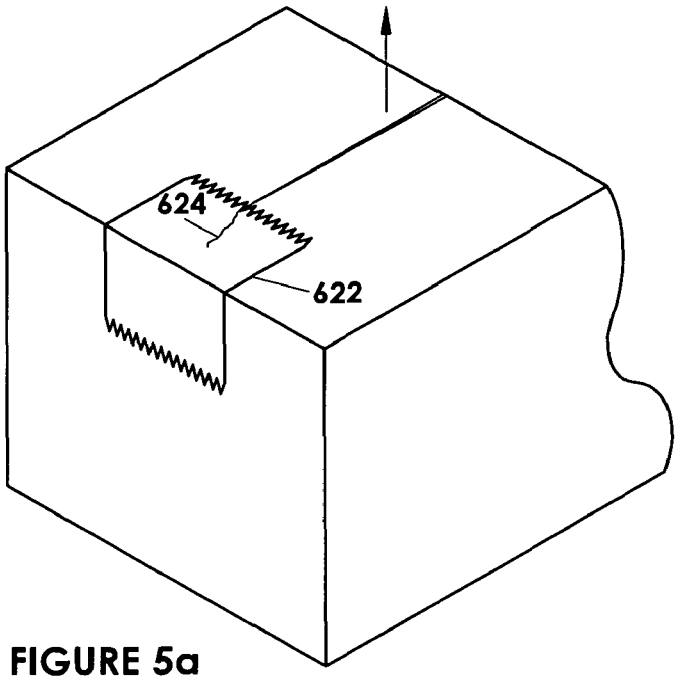
FIGS. 5*a* and 5*b* illustrate tape applications with different cut off patterns.
Figure 5D:
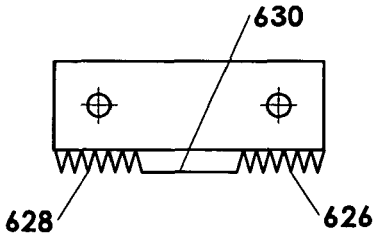
Figure 5E:
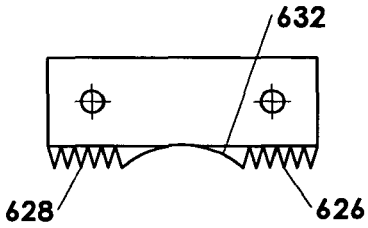
Figure 5B:
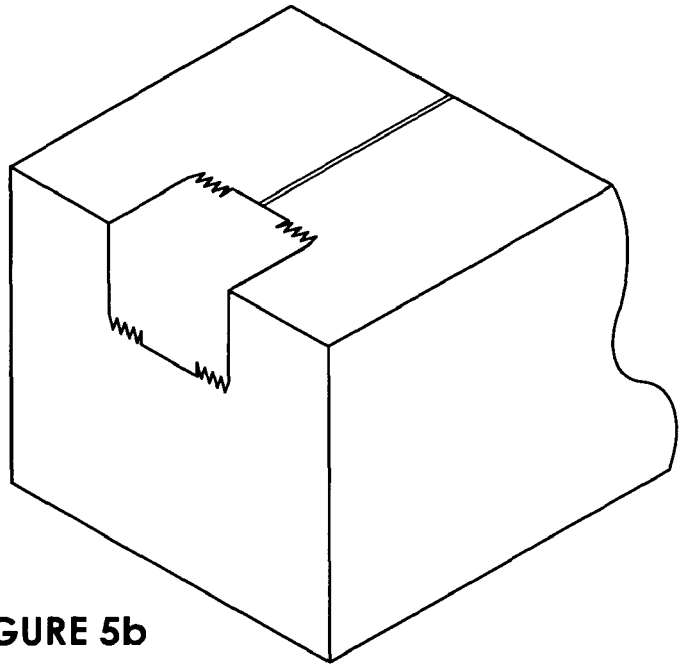

FIG. 5*c* shows a conventional serrated edge as is normally used in tape applicators and FIG. 5*a* shows an L-clip 622 cut using such a knife. As indicated at 624 a split has been found to occur regularly when this kind of knife edge is used. To overcome this problem applicant has found that if a serrated cutter is used to cut only adjacent to the edges of the tape 18 as indicated at 626 and 628 in FIGS. 5*d* and 5*e* and the intervening length between the serrated portion 626 and 628 is cut by a straight or curved blade 630 and 632 respectively the tendency is significantly reduced. The L-clip 634 shown in FIG. 5*b* is produced using the knife shown in FIG. 5*d*.

Figure 6A:
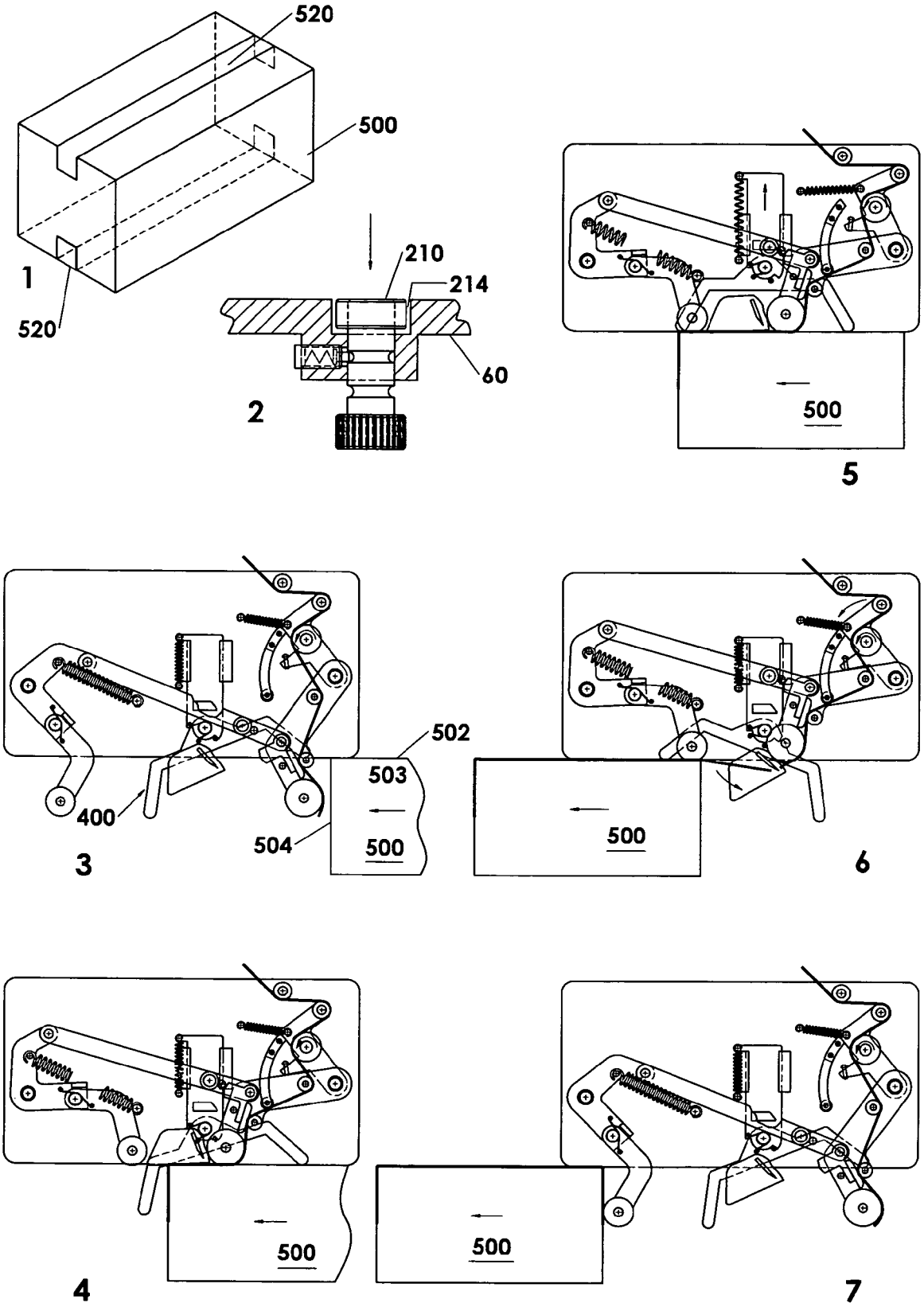

FIG. 6*a*-1 shows a carton 500 sealed with top and bottom C-clip tapes as indicated at 520 (see also FIG. 4*a*). This sealed carton shown in FIG. 6*a*-1 is produced by the mechanical form of the present invention shown in FIGS. 1 and 2 which uses the set up shown in FIG. 6*a*-2 wherein the cam follower 210 is in the pocket 214 on the link 60 i.e. in its inactive position.

Figure 4:
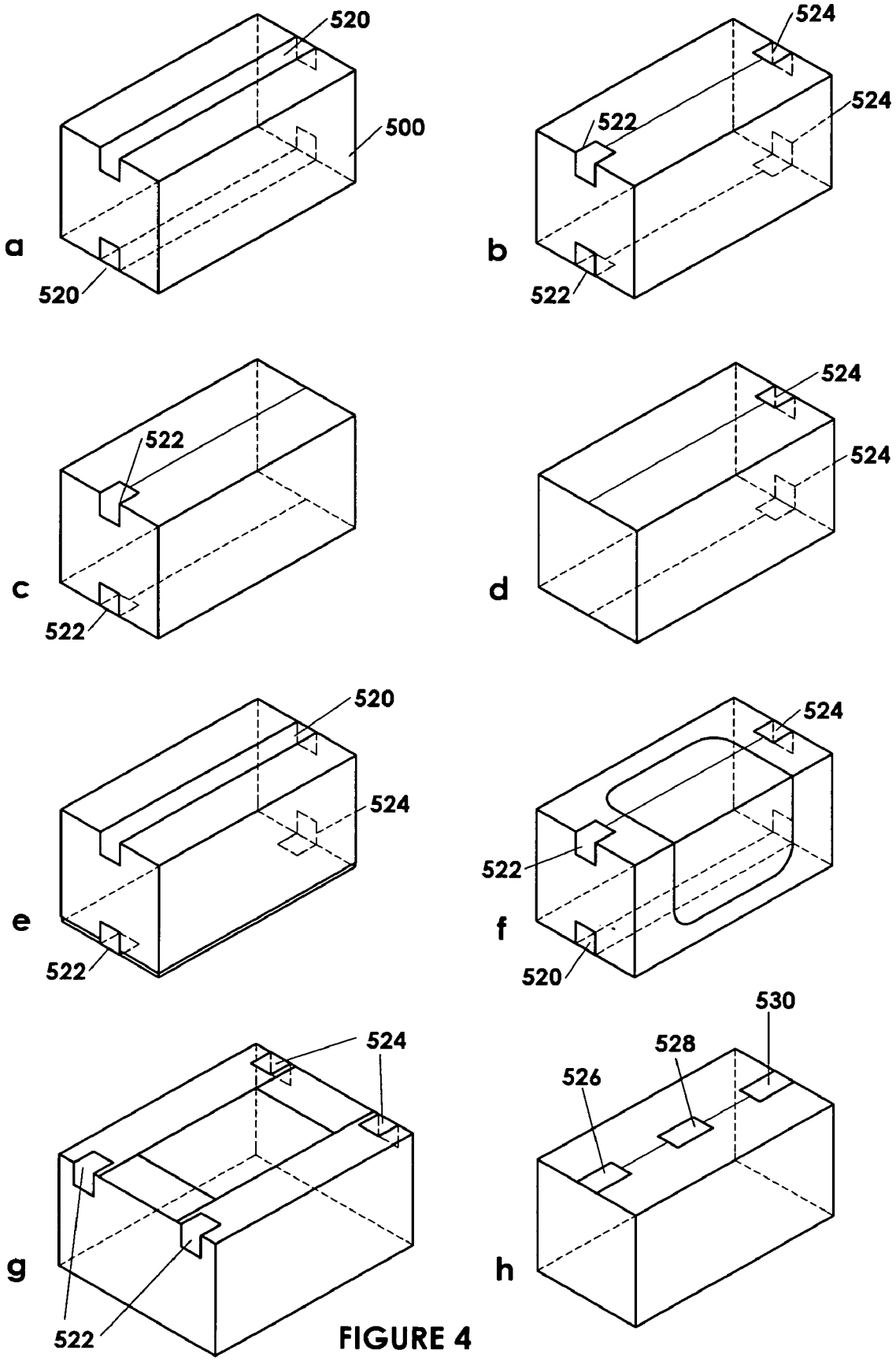

FIGS. 6*a*-3, 4, 5, 6, 7 shows the sequence of operation for C-clip tape application of the multifunctional tape applicator 10 with cam actuation of actuating cam 400. The carton 500 moves against and displaces the roll 30 in the conventional manner as shown in FIGS. 6*a*-3 and 6*a*-4 to apply tape to the leading face 504 an start along the face 502 and carries on in the conventional manner to complete the taping as shown in sequence in 6*a*-5,6*a*-6 and 6*a*-7. The cam 400 is disabled as the cam roller 210 cannot engage the cam plate 208.

Figure 6B:
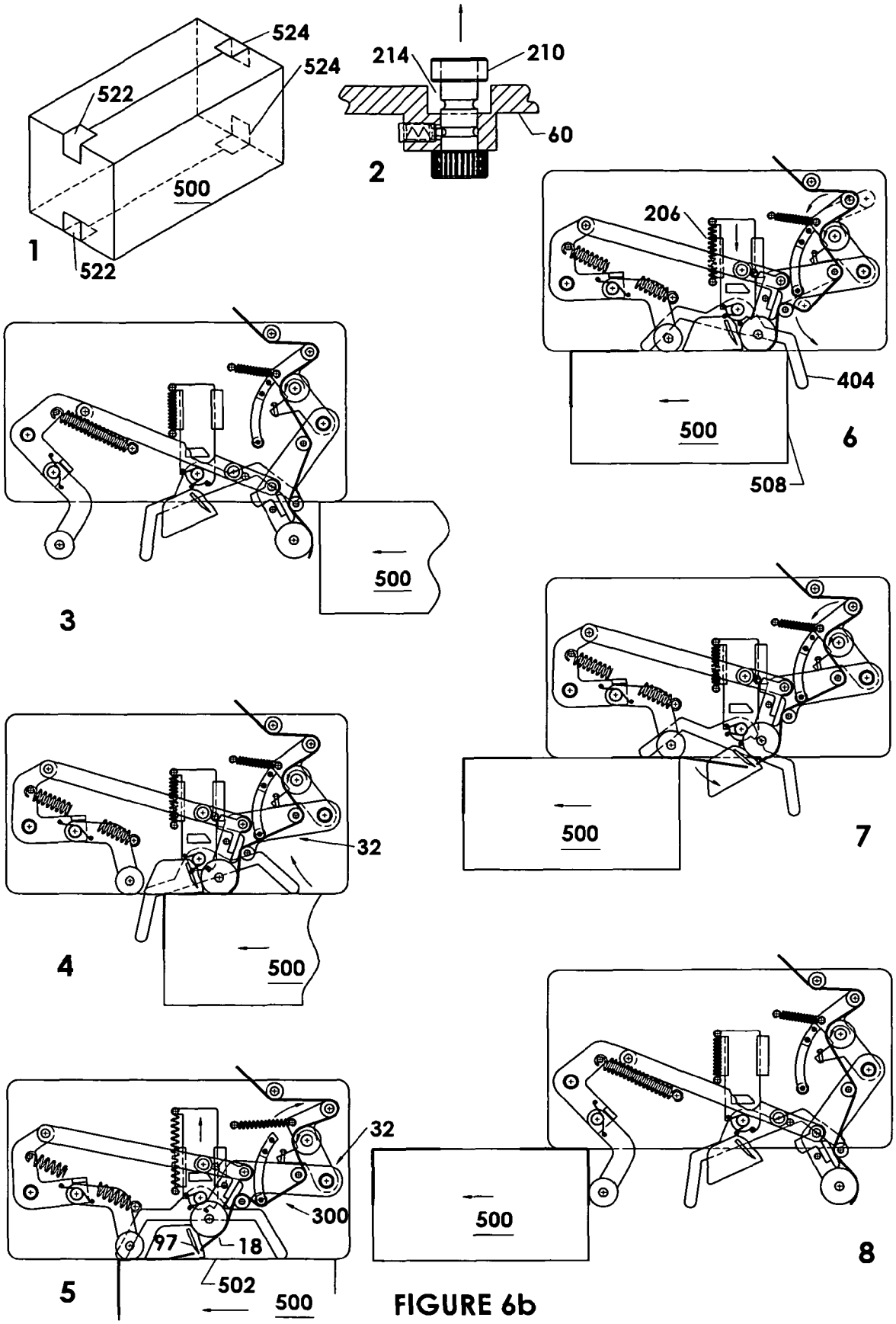
Figure 6C:
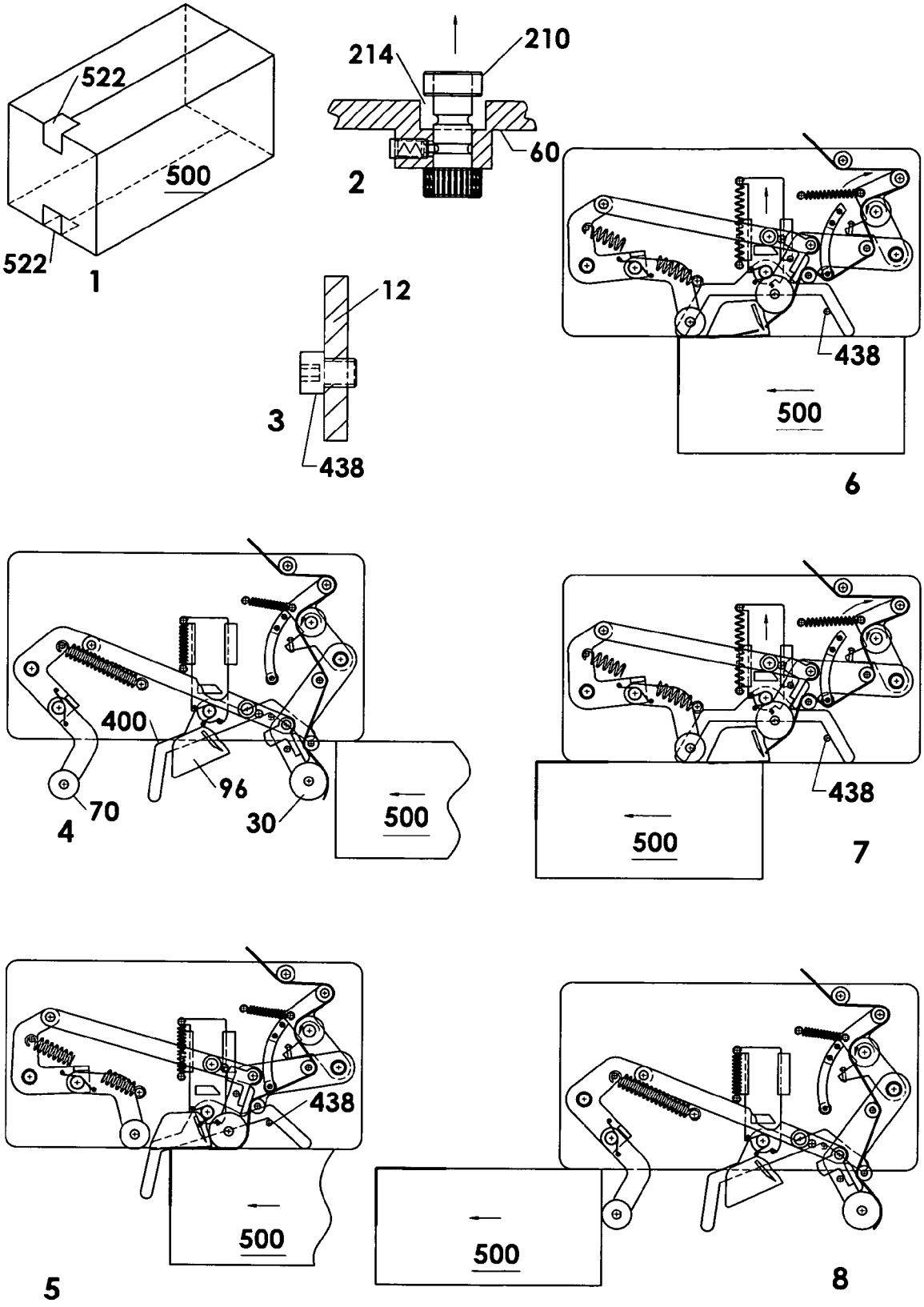
Figure 6D:
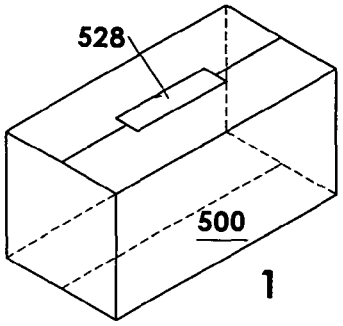
Figure 6D:
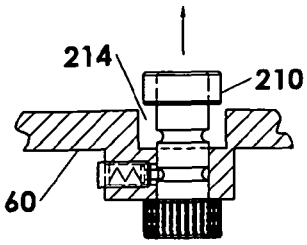
Figure 6D:
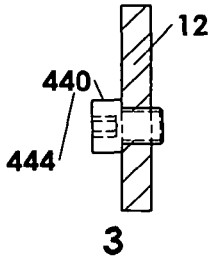
Figure 6D:
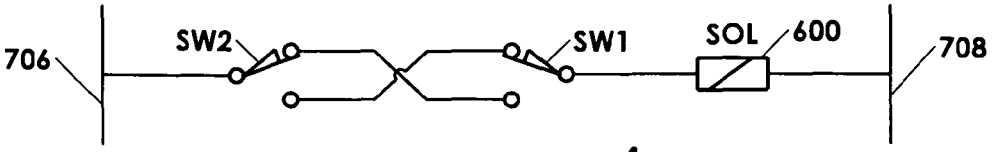
Figure 6D:
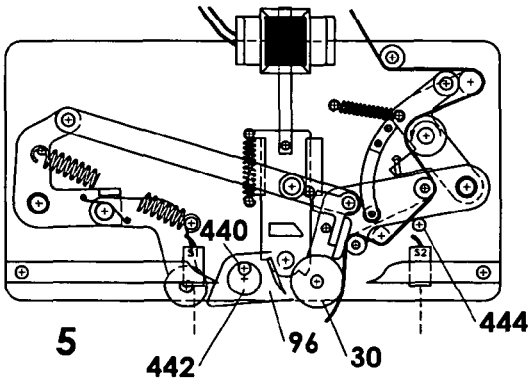
Figure 6D:
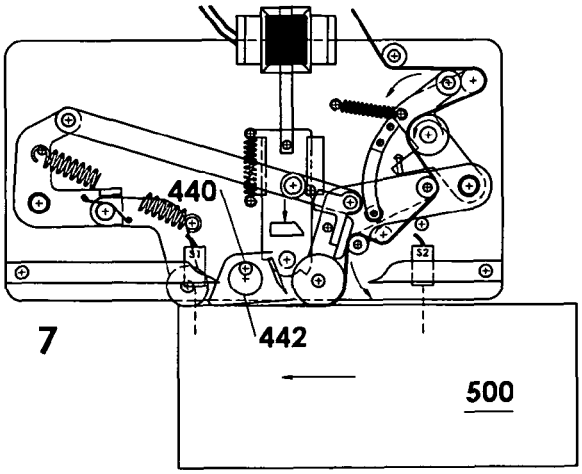
Figure 6D:
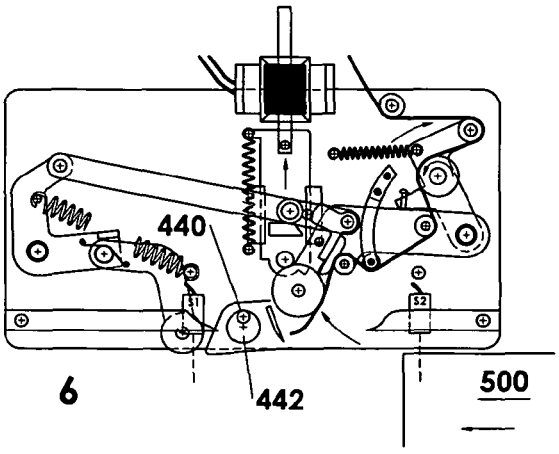
Figure 6D:
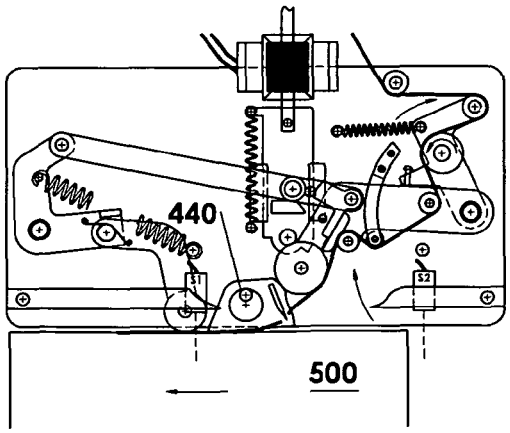

FIG. 6*b*-1 shows a carton sealed with front and rear L-clip tapes on top and bottom as described above with reference to FIG. 4*b*. This sealed carton shown in FIG. 6*b*-1 is produced by the mechanical form of the present invention shown in FIGS. 1 and 2 which uses the set up shown in FIG. 6*b*-2 wherein the cam follower 210 is out of the pocket 214 on the link 60 i.e. in its operative position.

FIGS. 6*b*-3, 4, 5, 6, 7, 8 show the sequence of operation for front and rear L-clip tape application of the multifunctional tape applicator with cam actuation and set-up requirements as shown on FIG. 6*b*-2. With the cam roll 210 in operative position when the slide 202 is moved up by the action of the cam 400 the engagement of the roll 210 with the plate cam 208 moves the application assembly 32 to the over-travel position 300 (see FIG. 6*b*-5) wherein the tape 18 is clear of the face 502 and is cut by the knife 97. The device remains in this over-travel position until the trailing leg 404 of the cam 400 clears the rear face 508 of the carton 500 and permits the cam 400 to turn clockwise and thereby release the slide 202 so that it is pulled toward the carton by the spring 206 which permits the spring 56 to return the roll 30 into pressing relationship with the surface 502 and apply the leading end of the trailing L-clip to the surface 502 at a spaced distance from the leading L-clip. The remainder of the application of the trailing L-clip is the same as for a conventional C-clip FIG. 6*c*-1 shows a carton sealed with only front or leading L-clip tapes on top and bottom. This sealed carton shown in FIG. 6*c*-1 is produced by the mechanical form of the present invention shown in FIGS. 1 and 2 which uses the set up shown in FIGS. 6*c*-2 and 6*c*-3 wherein the cam follower 210 is out of the pocket 214 on the link 60 i.e. in its operative position and the pin 438 is mounted in the plate 12. In this set up the pin 438 restricts the movement of the leg 404 toward the carton thereby to prevent the rear L-clip tape application by maintaining the over-travel position until the carton releases the leg 402 as shown by the actions shown in sequence in FIGS. 6*c*-4 to 6*c*-8.

FIG. 6*d*-1 shown a carton sealed only with a flat tape section 528 such as that shown in FIG. 4*h*. This sealed carton shown in FIG. 6*d*-1 is produced by the sensor and solenoid form of the present invention as shown in FIG. 3*a* which uses the set up shown in FIGS. 6*d*-2 and 6*d*-3 wherein the cam follower 210 is out of the pocket 214 on the link 60 i.e. in its operative position and the pin 440 is mounted in the plate 12 and is received in hole 442 in the knife assembly 96 and the second pin 438 mounted as indicated on the base plate 12 of the tape applicator to hold the applicator roll arm 34 with the apply roll 30 at the surface 502 of the carton. The application roll arm 34 has to be lifted by hand to insert the stop pin 438 onto the base plate 12. The stop pin 438 restricts the movement of the application roll 30 and the wipe-down roll 70 below the level of surface 502 assuming 502 is at the top of the carton. Obviously if 502 was the bottom this level would be above.

FIG. 6*d*-4 shows a typical control circuit with two switches SW1, SW2, (described above and below as the sensors S1 and S2 and may be part of the sensors S1 and S2) both with normally open and normally close contacts connected to a solenoid SOL 600, wired to the power sources 706, 708. SW2 switch is wired with common to the power source 706, normally close contact to the normally open contact of Sw1 switch, Sw1 switch is wired with common to the solenoid 600 and normally close contact to the normally open contact of SW2 switch. The other power source wire 708 is connected to the solenoid 600. The control circuit allows the actuation of the solenoid 600 with SW2 switch activated, SW1 switch de-activated as shown on FIG. 6*d*-6 and with SW2 switch de-activated, SW1 switch activated as shown on FIG. 6*d*-8. The control circuit also turns off the actuation of the solenoid 600 with SW1 switch activated, S2 switch activated (as shown on FIG. 6*d*-7) and with both SW2 switch and S1 switch de-activated as shown on FIG. 6*d*-5.

SW2 switch mounted to the front of the tape applicator, SW1 switch mounted down-stream of the tape applicator, both with equal distance measuring from the switch or sensor to the cutting blade 97 for positioning the section of tape in the middle of the carton.

FIG. 6*d*-5, shows the normal home position when tape is being applied to the surface 502 but when a carton is initially fed to the machine as sensed for example by sensor S2 the solenoid 600 is activated to move the roll 30 to the over-travel position so the leading end of the tape can not make contact with surface 502 as shown in FIG. 6*d*-6 and when the sensor S1 senses the leading end of the carton 500 the solenoid 600 releases the slide plate 202 and the roll 30 applies the tape to the surface 502 as shown in FIG. 6*d*-7. When the trailing end or the carton 500 is sensed passing the sensor S2 the solenoid 600 is again activated to move the device to the over-travel position as shown in FIG. 6*d*-8 and the tape 18 is severed to define the length of the patch 528. When sensor S1 senses the passing of the trailing end of the carton 500 the solenoid 600 is deactivated to permit the applicator to return to home position shown in FIG. 6*d*-5.

Having described the invention, modifications will be evident to those skilled in the art without departing from the scope of the invention as defined in the appended claims.

I claim:

1. A tape applicator for applying a closing tape ribbon to a carton in the form of a pair of spaced L-clips as a leading L-clip positioned on a leading face and a trailing L-clip at a trailing face of said carton comprising a frame, a source of tape mounted on said frame, an application roll assembly including an applicator to apply a leading end of a tape from said source to said leading face and around an edge and an adjacent face of a carton moving relative to said tape applicator pivotably mounted on said frame, a wipe down assembly including a wipe down to wipe a tape applied to said carton along said trailing face of said carton remote from said leading face pivotably mounted on said frame, a push bar link interconnecting said application roll assembly and said wipe down assembly for movement together, an over-travel system for moving said applicator from said adjacent face of said carton to an over-travel position spaced from said adjacent face, said over-travel system including an actuator to move said applicator roll assembly and thereby move-said applicator to said over-travel position and a cutting assembly including a cut off knife positioned to engage said tape when said a over-travel system moves said applicator to said over-travel position and wherein said over-travel system moves said applicator back to said carton from said over-travel position to apply said trailing L-clip.

2. A tape applicator as defined in claim 1 further comprising a lost motion connection connecting said push bar link to one of said application roll assembly and said wipe down assembly.

3. A tape applicator as defined in claim 1 wherein said over-travel system includes a moveable member mounted on said frame and on which is mounted a cam element, and wherein said actuator moves said member and thereby said cam element to its over-travel position, a cam follower on said push bar link to engage said cam element to move said application roll assembly to said over-travel position.

4. A tape applicator as defined in claim 3 wherein said moveable member is a link pivotably mounted on said frame.

5. A tape applicator as defined in claim 3 wherein said moveable member is a slide plate slidably mounted on said frame.

6. A tape applicator as defined in claim 1 wherein said actuator is an actuator cam having a leading face engaging leg and a trailing leg and a bridging section there between, said actuator cam positioned so that said leading face engaging leg engages said leading face and then said adjacent face of said carton as said carton is moved relative to said tape applicator to move said applicator roll to said over-travel position.

7. A tape applicator as defined in claim 1 further comprising a tape control system comprising a brake pad mounted on a brake assembly pivotably mounted on an applicator arm of said application roll assembly adjacent to an exit roll over which said tape travels on route to said applicator, and a pressure cam pin mounted on said push bar link in a position to engage said pivoted brake assembly when said application roll assembly is moved to said over-travel position to pinch said tape between brake pad and said exit roller.

8. A tape applicator as defined in claim 7 wherein said tape control system also comprises a tape path from a source of said tape between as source roll of said tape and said applicator wherein said tape is directed over an entry roll and a one way clutch roll en route to said application roll assembly and a dancer roller mounted to engage said tape in said tape path between entry roll and said one-way clutch roll and to advance extra length of tape when said application roll assembly is moved to said over-travel position.

9. A tape applicator as defined in claim 8 wherein said tape control system further comprises a stationary extension roller positioned to intersect said tape path between a tape guide roller and said exit roller mounted on said applicator arm when said application roll assembly is moved to said over-travel position thereby to advance extra tape between said brake pad and a one way clutch roll when tape being pinched by the brake pad.

10. A tape applicator as defined in claim 3 wherein said actuator is an actuator cam having a leading face engaging leg and a trailing leg and a bridging section there between, said actuator cam positioned so that said leading face engaging leg engages said leading face and then said adjacent face of said carton as said carton is moved relative to said tape applicator and wherein said actuator cam is connected to move said moveable member.

11. A tape applicator as defined in claim 10 wherein said moveable member is a link pivotably mounted on said frame.

12. A tape applicator as defined in claim 10 wherein said moveable member is a slide plate slidably mounted on said frame.

13. A tape applicator as defined in claim 1 wherein said tape applicator is a multifunction tape applicator and where means are included to disable said actuator to move said applicator roll assembly.

14. A tape applicator as defined in claim 7 wherein said tape applicator is a multifunction tape applicator and where means are included to disable said actuator to move said applicator roll assembly.

15. A tape applicator as defined in claim 3 wherein said tape applicator is a multifunction tape applicator and where means are included to disable said actuator to move said applicator roll assembly.

16. A tape applicator as defined in claim 10 wherein said tape applicator is a multifunction tape applicator and where means are included to disable said actuator to move said applicator roll assembly.

* * * * *